US009763526B2

(12) United States Patent
Thomas et al.

(10) Patent No.: US 9,763,526 B2
(45) **Date of Patent: *Sep. 19, 2017**

(54) LED LIGHT FIXTURE ASSEMBLY WITH ELONGATED STRUCTURAL FRAME MEMBERS

(71) Applicant: ELECTRALED, INC., Largo, FL (US)

(72) Inventors: James Thomas, Tierra Verde, FL (US); Vladimir Volochine, Safety Harbor, FL (US)

(73) Assignee: ElectraLED, Inc., Largo, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/886,651

(22) Filed: Oct. 19, 2015

(65) Prior Publication Data

US 2016/0040860 A1 Feb. 11, 2016

Related U.S. Application Data

(63) Continuation of application No. 14/665,537, filed on Mar. 23, 2015, now Pat. No. 9,163,812, which is a (Continued)

(51) Int. Cl.
*A47F 3/00* (2006.01)
*F21V 19/00* (2006.01)
(Continued)

(52) U.S. Cl.
CPC ..... *A47F 3/001* (2013.01); *F21S 4/28* (2016.01); *F21V 19/003* (2013.01);
(Continued)

(58) Field of Classification Search
CPC .. A47F 3/001; F25D 21/04; F21S 4/28; F21V 15/013; F21V 19/003; F21V 29/70;
(Continued)

(56) References Cited

U.S. PATENT DOCUMENTS 3,936,686 A 2/1976 Moore
4,143,411 A 3/1979 Roberts
(Continued)

FOREIGN PATENT DOCUMENTS

JP 3142490 6/2008

OTHER PUBLICATIONS

PCT/US2009/005506 International Search Report and Written Opinion of the International Searching Authority mailed May 12, 2010.

*Primary Examiner* — Stephen F Husar

(74) *Attorney, Agent, or Firm* — McDermott Will & Emery LLP

(57) ABSTRACT

An LED light fixture assembly includes an elongated first support member, an elongated second support member spaced from and substantially parallel to the first support member, and a plurality of elongated LED lighting fixtures coupled to and extending between the first support member and the second support member. Each LED lighting fixture includes an elongated structural frame member having a substantially channel shaped support portion, and a mounting portion opposite the support portion. Each LED lighting fixture also includes a plurality of LED light modules secured to and positioned along the mounting portion, and a cover extending along and supported by the mounting portion. The cover is positioned so light emitted from the plurality of LED light modules passes through the cover and away from the mounting portion.

21 Claims, 13 Drawing Sheets

Related U.S. Application Data continuation of application No. 13/939,571, filed on Jul. 11, 2013, now Pat. No. 8,985,795, which is a continuation-in-part of application No. 13/525,818, filed on Jun. 18, 2012, now Pat. No. 8,496,359, which is a continuation of application No. 12/587,514, filed on Oct. 7, 2009, now Pat. No. 8,201,977, and a continuation-in-part of application No. 12/587,559, filed on Oct. 7, 2009, now Pat. No. 8,956,005, and a continuation-in-part of application No. 11/821,793, filed on Jun. 25, 2007, now Pat. No. 8,235,539.

(60) Provisional application No. 61/195,399, filed on Oct. 7, 2008, provisional application No. 61/195,399, filed on Oct. 7, 2008, provisional application No. 60/817,913, filed on Jun. 30, 2006.

(51) Int. Cl.

| | |
|---|---|
| ***F21S 4/28*** | (2016.01) |
| *F21W 131/405* | (2006.01) |
| *F21V 15/01* | (2006.01) |
| *F21W 131/305* | (2006.01) |
| *F21V 29/70* | (2015.01) |
| *F25D 21/04* | (2006.01) |
| *F21Y 103/10* | (2016.01) |
| *F21Y 115/10* | (2016.01) |

(52) U.S. Cl.

CPC ..... *F21V 15/013* (2013.01); *F21V 29/70* (2015.01); *F21W 2131/305* (2013.01); *F21W 2131/405* (2013.01); *F21Y 2103/10* (2016.08); *F21Y 2115/10* (2016.08); *F25D 21/04* (2013.01)

(58) Field of Classification Search

CPC ..... F21W 2131/305; F21W 2131/405; F21Y 2101/00; F21Y 2103/10; F21Y 2115/10

See application file for complete search history.

(56) References Cited

U.S. PATENT DOCUMENTS

| | | | | |
|---|---|---|---|---|
| 4,149,217 | A | 4/1979 | Tucker | |
| 4,416,411 | A | 11/1983 | Desmond et al. | |
| 4,612,206 | A | 9/1986 | Shimozato et al. | |
| 4,612,606 | A | 9/1986 | Roberts | |
| 4,720,773 | A | 1/1988 | Ahroni | |
| 4,855,882 | A | 8/1989 | Boss | |
| 4,908,743 | A | 3/1990 | Miller | |
| 5,015,918 | A | 5/1991 | Copeland | |
| 5,103,382 | A | 4/1992 | Kondo et al. | |
| 5,222,799 | A | 6/1993 | Sears et al. | |
| 5,499,170 | A | 3/1996 | Gagne | |
| 5,526,236 | A | 6/1996 | Burnes et al. | |
| 5,607,227 | A | 3/1997 | Yasumoto et al. | |
| 5,697,175 | A | 12/1997 | Schwartz | |
| 5,746,497 | A | 5/1998 | Machida | |
| 5,857,767 | A | 1/1999 | Hochstein | |
| 5,892,192 | A | 4/1999 | Ishiguro et al. | |
| 5,924,785 | A | 7/1999 | Zhang et al. | |
| 5,931,577 | A | 8/1999 | Ishibashi | |
| 6,045,240 | A | 4/2000 | Hochstein | |
| 6,072,280 | A | 6/2000 | Allen | |
| 6,116,748 | A | 9/2000 | George | |
| 6,137,648 | A | 10/2000 | Higurashi | |
| 6,183,104 | B1 | 2/2001 | Ferrara | |
| 6,244,728 | B1 | 6/2001 | Cote et al. | |
| 6,283,612 | B1 | 9/2001 | Hunter | |
| 6,346,777 | B1 | 2/2002 | Kim | |
| 6,350,039 | B1 | 2/2002 | Lee | |
| 6,371,637 | B1 | 4/2002 | Atchinson et al. | |
| 6,394,626 | B1 | 5/2002 | McColloch | |
| 6,396,466 | B1 | 5/2002 | Pross et al. | |
| 6,416,200 | B1 | 7/2002 | George | |
| 6,431,728 | B1 | 8/2002 | Fredericks et al. | |
| 6,573,536 | B1 | 6/2003 | Dry | |
| 6,578,979 | B2 | 6/2003 | Truttmann-Battig | |
| 6,578,986 | B2 | 6/2003 | Swaris et al. | |
| 6,617,520 | B1 | 9/2003 | Martter et al. | |
| 6,641,283 | B1 | 11/2003 | Bohler | |
| 6,665,170 | B1 | 12/2003 | Warner et al. | |
| 6,712,486 | B1 | 3/2004 | Popovich et al. | |
| 6,815,724 | B2 | 11/2004 | Dry | |
| 6,831,303 | B2 | 12/2004 | Dry | |
| 6,846,093 | B2 | 1/2005 | Swaris et al. | |
| 7,114,831 | B2 | 10/2006 | Popovich et al. | |
| 7,121,675 | B2 | 10/2006 | Ter-Hovhannisian | |
| 7,350,955 | B2 | 4/2008 | Chang et al. | |
| 8,201,977 | B2 | 6/2012 | Thomas et al. | |
| 8,235,539 | B2 * | 8/2012 | Thomas | F21V 15/013 362/92 |
| 8,496,359 | B2 * | 7/2013 | Thomas | A47F 3/001 362/125 |
| 8,956,005 | B2 * | 2/2015 | Thomas | F21S 4/008 362/217.1 |
| 8,985,795 | B2 | 3/2015 | Thomas et al. | |
| 9,163,812 | B2 * | 10/2015 | Thomas | F21V 21/00 |
| 2001/0015891 | A1 | 8/2001 | Suzuki et al. | |
| 2003/0218878 | A1 | 11/2003 | Swaris et al. | |
| 2005/0259424 | A1 | 11/2005 | Zampini et al. | |
| 2005/0265019 | A1 | 12/2005 | Sommers et al. | |
| 2007/0047229 | A1 | 3/2007 | Lee | |
| 2007/0153508 | A1 | 7/2007 | Nall et al. | |
| 2007/0159820 | A1 | 7/2007 | Crandell et al. | |
| 2007/0291473 | A1 | 12/2007 | Traynor | |
| 2008/0007945 | A1 | 1/2008 | Kelly et al. | |
| 2010/0103672 | A1 | 4/2010 | Thomas et al. | |
| 2011/0038145 | A1 | 2/2011 | Davenport et al. | |

* cited by examiner

LED LIGHT FIXTURE ASSEMBLY WITH ELONGATED STRUCTURAL FRAME MEMBERS

CROSS-REFERENCE TO RELATED APPLICATIONS

This is a continuation of U.S. patent application Ser. No. 14/665,537, filed Mar. 23, 2015, now U.S. Pat. No. 9,163,812, which is a continuation of U.S. patent application Ser. No. 13/939,571, filed Jul. 11, 2013, now U.S. Pat. No. 8,985,795, which is a continuation-in-part of U.S. patent application Ser. No. 13/525,818, filed Jun. 18, 2012, now U.S. Pat. No. 8,496,359, which is a continuation of U.S. patent application Ser. No. 12/587,514, filed Oct. 7, 2009, now U.S. Pat. No. 8,201,977, which claims the benefit of and priority to U.S. Patent Application No. 61/195,399, filed Oct. 7, 2008. This is also a continuation-in-part of U.S. patent application Ser. No. 12/587,559, filed Oct. 7, 2009, now U.S. Pat. No. 8,956,005, which claims the benefit of and priority to U.S. Provisional Application No. 61/195,399, filed Oct. 7, 2008. U.S. patent application Ser. No. 12/587,559 is also a continuation-in-part of U.S. patent application Ser. No. 11/821,793, filed Jun. 25, 2007, now U.S. Pat. No. 8,235,539, which claims the benefit of and priority to U.S. Provisional Application No. 60/817,913, filed on Jun. 30, 2006. The entire contents of each of the foregoing applications, publications, and patents are hereby incorporated by reference herein.

TECHNICAL FIELD

The invention relates to a free-standing light fixture assembly including spaced apart elongated light emitting diode (LED) lighting fixtures coupled together by end plates. Each LED lighting fixture may include multiple LEDs arrayed in two groups that are angled to each other. Each LED lighting fixture may also include a channel-shaped or beam-shaped frame that acts as a structural support member for the light fixture assembly. The fixture may include an elongated frame member having support portions to which arrays of LED modules are mounted.

BACKGROUND OF THE INVENTION

There currently exists a number of lighting fixtures utilizing LEDs as the light source. While such fixtures provide some beneficial features, they nevertheless suffer from a number of limitations, including but not limited to, uneven light distribution and brightness, high material and component costs, difficult and time-consuming assembly, and cumbersome housing configurations that hamper installation and thus prevent custom applications. An example of a lighting fixture suffering from the above limitations is disclosed in U.S. Pat. No. 6,283,612. There, the fixture comprises a hollow tube 20 with a single, linear array of LEDs 44 extending from a printed circuit board 22, along with a plurality of resistors 38. The bottom 26 of the board 22 has a full length conductive bus 28 and a full length conductive negative bus 30, with each bus 28, 30 located adjacent an opposed outside edge of the board 22. The anode 46 of the LED 44 is in communication with a second lead 42 of one of the resistors 38, and the cathode 48 is in communication with an adjacent LED 44 connected in series. A pair of end caps 50 are hermetically sealed to the tube 20 with adhesive 54 to secure the circuit board 22 within the tube 20, where the end caps 50 have a bore 56 that accept a cord 60. A resilient gasket 58 is disposed between the circuit board 22 and each end cap 50 to further secure the circuit board 22 within the hollow tube 20. An external power supply 64 provides direct current power to the single array of LEDs 44. A U-shaped mounting bracket 66 is utilized to mount the tube 20 for installation. Because the LEDs 44 are linearly arranged in a single plane, the tube 20 produces a limited range of light that is uneven and susceptible to undesirable "hot spots." This poor lighting performance renders the tube 20 commercially unfeasible.

Further, refrigerated display cases, often referred to as coolers or freezers, are commonly found in grocery stores, markets, convenience stores, liquor stores and other retail businesses for the preservation and display of food and beverages. Conventional display cases comprise an inner refrigerated space defined by a collection of structural elements, and an opening further defined by the structural elements that is accessible by a sliding or swinging door. Typically, the door is formed from a plurality of frame members that support at least one layer of glass and a handle. The collection of structural elements that form the display case include interior and exterior frame members, including "mullions" which are vertical elements that extend between upper and lower frame members. An end mullion is a peripheral vertical element that is located at one end of the display case, and a center mullion is a central vertical element that is located between two openable doors. The mullion provides an engaging surface for the door seals that are used to maintain the lower temperature within the display case. As such, the mullion is part of a door frame sealing system for the free-standing display case.

Certain retail businesses, such as convenience and liquor stores, include a "walk-in" cooler or room instead of a free-standing refrigerated display case. These walk-in coolers are not free-standing as recognized within the industry, however, they include a number of similar components including mullions and openable doors with seals.

Regardless of whether the refrigerated case is free-standing or walk-in, the door frame members and the door glass conduct ambient heat into the display case and function as a condensation surface for water vapor present in the ambient air.

The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

In some aspects an LED light fixture assembly includes an elongated first support member, an elongated second support member spaced from and substantially parallel to the first support member, and a plurality of elongated LED lighting fixtures coupled to and extending between the first support member and the second support member. The plurality of elongated LED lighting fixtures are arranged in substantially parallel and spaced-apart relation with respect to one another. Each LED lighting fixture includes an elongated structural frame member having a substantially channel shaped support portion, and a mounting portion opposite the support portion. Each LED lighting fixture also includes a plurality of LED light modules secured to and positioned along the mounting portion, and a cover extending along and supported by the mounting portion. The cover is positioned so light emitted from the plurality of LED light modules passes through the cover and away from the mounting portion.

The first and second support members may extend substantially horizontally with the second support member positioned above the first support member. The plurality of elongated LED lighting fixtures may extend substantially vertically, and the second support member may be supported above the first support member exclusively by the plurality of elongated LED lighting fixtures. The support portion may be substantially C-shaped and may include a pair of opposed side walls and a base wall extending between the opposed side walls. The side walls may be substantially parallel to one another and the base wall may be substantially perpendicular to the side walls. The mounting portion may extend between distal ends of the side walls, and the mounting portion and the support portion may cooperate to define a closed box section. Each LED lighting fixture may be substantially symmetric about a central plane. The mounting portion may include a first wall and a second wall angled with respect to the first wall, and the plurality of LED light modules may be mounted to the first wall. Each LED lighting fixture may further include an optical assembly extending between the first wall, the second wall, and the cover. The first wall may define a first slot and the second wall may define a second slot, and opposing edges of the cover may be received in respective ones of the first slot and the second slot.

In other aspects, an elongated LED lighting fixture includes an elongated structural frame member having a substantially channel shaped support portion, and a mounting portion opposite the support portion. The support portion is substantially C-shaped and includes a pair of opposed side walls and a base wall extending between the opposed side walls. A plurality of LED light modules is secured to and positioned along the mounting portion, and a cover extends along and is supported by the mounting portion. The cover is positioned so light emitted from the plurality of LED light modules passes through the cover and away from the mounting portion.

The side walls may be substantially parallel to one another and the base wall may be substantially perpendicular to the side walls. The mounting portion may extend between distal ends of the side walls, and the mounting portion and the support portion may cooperate to define a closed box section. The LED lighting fixture may be substantially symmetric about a central plane. The mounting portion may include a first wall and a second wall angled with respect to the first wall, and wherein the plurality of LED light modules may be mounted to the first wall.

In still other aspects, an elongated LED lighting fixture includes an elongated structural frame member. The frame member includes a substantially C-shaped support portion having a pair of opposed side walls and a base wall extending between the opposed side walls substantially perpendicular to the side walls. The frame member further includes a mounting portion extending between distal ends of the side walls. The mounting portion and the support portion cooperate to define a closed box section. The mounting portion includes two opposed first surfaces symmetrically arranged about a central plane, and two second surfaces symmetrically arranged about the central plane. Each second surface is angled with respect to a respective one of the first surfaces. Each first surface defines a first slot, and each second surface defines a second slot. A first plurality of LED light modules and a second plurality of LED light modules are each secured to and positioned along a respective one of the first surfaces. First and second covers including opposing edges received in respective ones of the first slots and the second slots. Each cover is positioned so light emitted from a respective one of the first and second plurality of LED light modules passes through the cover and away from the mounting portion. First and second optical assemblies are positioned between the first plurality of LED light modules and the first cover, and the second optical assembly positioned between the second plurality of LED light modules and the second cover.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
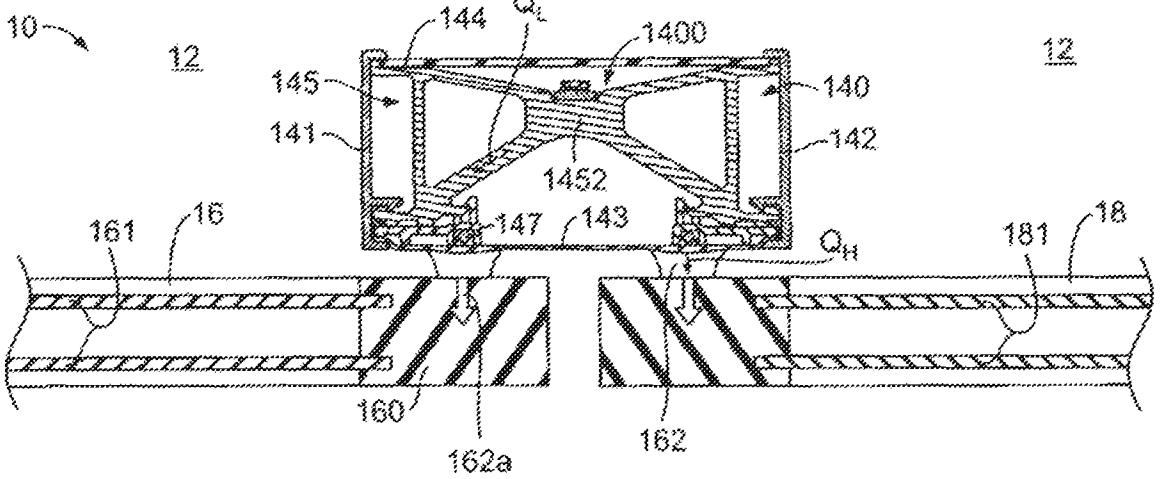
FIG. 1 is a partial cross-section of a refrigerated display case showing a first LED illuminated mullion and two openable doors.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
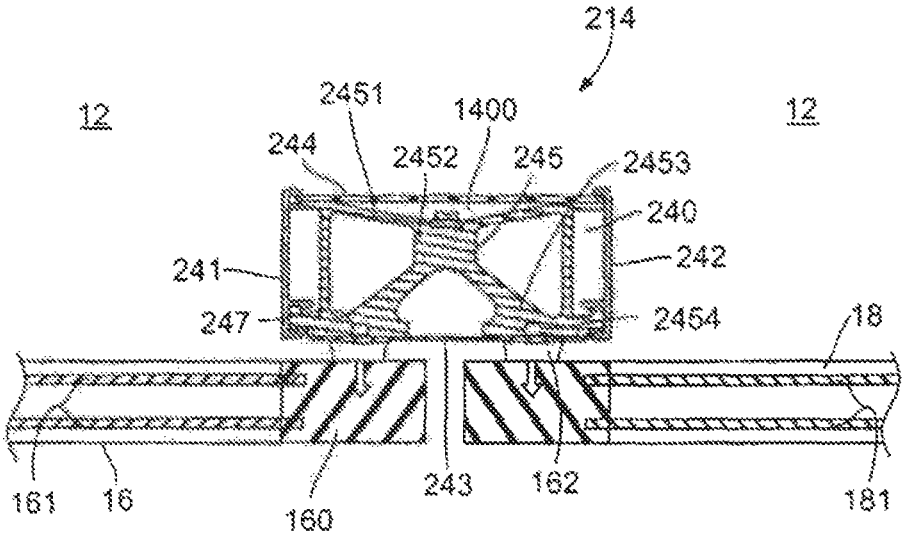
FIG. 2 is a partial cross-section of a refrigerated display case showing a second LED illuminated mullion and two openable doors.
Figure 3:
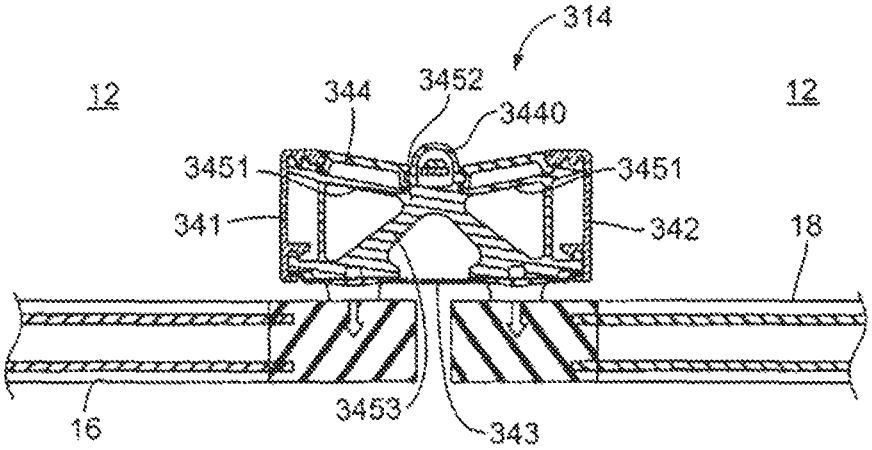
FIG. 3 is a partial cross-section of a refrigerated display case showing a third LED illuminated mullion and two openable doors.

FIGS. 1-3 show a partial cross-section of a refrigerated display case 10 of the present invention. The display case 10 comprises a plurality of structural elements or members (not shown) that form the inner refrigerated space 12, and an illuminated central mullion 14 that resides between a first door 16 and a second door 18. Although not shown in these Figures, the display case 10 also includes illuminated end mullions at the periphery of the case 10. Conventional refrigerated display cases are disclosed in U.S. Pat. Nos. 6,637,093 and 6,606,833. The illuminated mullion of the present invention can also be utilized with walk-in coolers, which differ from standalone display cases or coolers.

Figure 4:
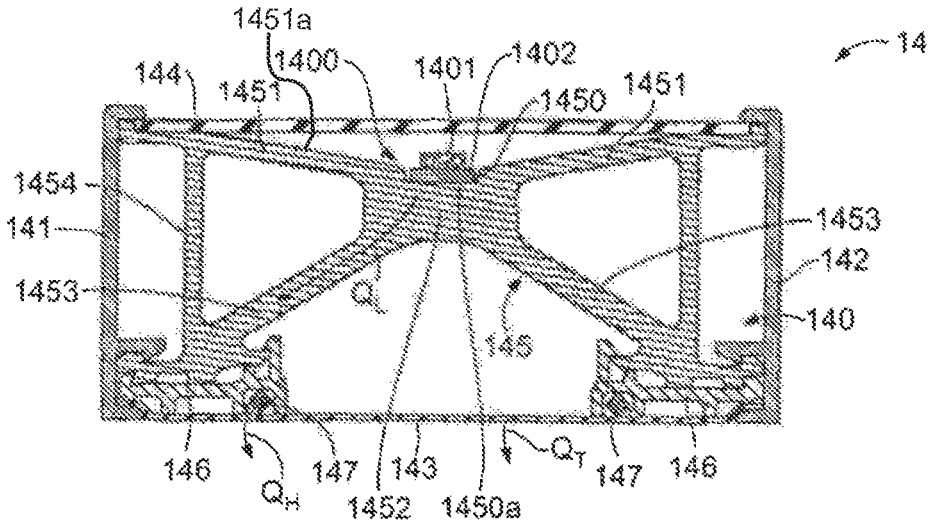
FIG. 4 is a cross-section of the illuminated mullion of FIG. 1.

Referring to FIGS. 1 and 4, the illuminated central mullion 14 has internal cavity 140 defined by a first side piece 141 and a second side piece 142 (both preferably plastic), a back plate 143 and a lens or generally transparent cover 144. An internal support 145 resides within the cavity 140 and includes an illumination assembly 1400 comprised of at least one light emitting diode (LED) 1401 electrically and mechanically connected to a printed circuit board (PCB) 1402. The back plate 143 and the internal support 145 are preferably formed from a thermally conductive material such as metal, namely aluminum. Preferably, the PCB 1402 is received by a channel 1450 of the internal support 145. Depending upon the length of the mullion 14, multiple LEDs 1401 are mounted to a number of PCBs 1402 secured to the internal support 145, wherein the PCBs 1402 are longitudinally secured in an end-to-end configuration. The internal support 145 has a pair of front arms 1451 that extend from a central hub 1452 and that provide a reflecting surface for light generated by the LEDs 1401 through the lens 144 and into the refrigerated space 12 in order to evenly illuminate the food and/or beverage products therein. The reflecting surface of the front arm 1451 ranges from 0 to 60 degrees from horizontal, and is preferably 10-15 degrees from horizontal, and is most preferably 11-12 degrees from horizontal (wherein the angle is defined by a horizontal reference line that is parallel to a bottom wall 1450*a* of the channel 1450, and preferably aligned with the bottom wall 1450*a*). The outer surface 1451*a* of the front arm 1451 is treated to increase the reflection of light from the LEDs 1401 into the refrigerated space 12. For example, the outer surface 1451*a* is buffed to provide a coefficient of reflection of 85 to 95, or a reflective tape is attached to the outer surface 1451*a*. The tape or coating secured to the outer surface 1451*a* may include metal particles and/or fibers. Also, the outer surface 1451*a* may be anodized to electrically insulate the front arm 1451. At least one rear arm 1453 extends from the central hub 1452 and engage a connector 146 for a heating element 147. A peripheral arm 1454 extends between the front arm 1451 and the rear arm 1453. As explained in greater detail below, during operation of the illumination system 1400, the internal support 145 transfers heat generated by the LEDs 1401 through the connector 146 to the back plate 143. Although not shown, the internal support 145 may include an additional arm that bypasses the connector 146 and directly contacts the back plate 143.

The first and second door assembly 16, 18 include a collection of frame member 160, at least one layer of display glass 161 and a sealing element or seal 162. The seal 162 includes a projection 162*a* that is received within a recess of the frame member 160 to secure the seal 162 to the member 160. In the closed door position of FIG. 1, an inner surface of the seal 162 is positioned against the back plate 143 and an outer surface of the seal 162 is positioned against the frame member 161, whereby the seal 162 is sandwiched between the mullion 14 and the door 16, 18 to maintain the temperature within the display case 10. Although not shown, it is understood that the mullion 14, the frame member 160 and the seal 162 have a substantial vertical dimension or height that extends within the display case 10.

In the embodiment of FIG. 2, the illuminated central mullion 214 has an internal cavity 240 defined by a first side piece 241 and a second side piece 242, a back plate 243 and a lens or generally transparent cover 244. An internal support 245 has at least one front arm 2451 and at least one rear arm 2453 both extending from the central hub 2452. The rear arm 2453 is configured with a receiver 2454 that receives the heating element 247, thereby omitting the connector 146. In this configuration, there is direct heat transfer from the LEDs 1401 and through the internal support 245 and the rear arm 2453 to the back plate 243. Compared to the rear arm 1453 of the internal support 145 of FIG. 1, the rear arm 2453 is larger with an increased interface area with the back plate 243 that contacts a seal 162. In the embodiment of FIG. 3, the illuminated central mullion 314 is similar to the central mullion 214 but includes a differently configured first side piece 341 and second side piece 342 that engage a lens cover 344 with a bulbous central portion 3440 that accommodates a raised illumination assembly 1400.

During operation of the display case 10, the LEDs 1401 of the illumination assembly 1400 generate significant heat $Q_L$ while illuminating the food and/or beverage contents within the case 10. For the mullion 14, heat $Q_L$ is transferred through the central hub 1452 and the rear arms 1453 and the connector 146 to the back plate 143. Therefore, a heat path for heat $Q_L$ is defined through the internal support 145. Regarding the mullion 214, heat $Q_L$ is transferred through the central hub 2452 and the rear arms 2453 to the back plate 243 and then the seals 162. For the mullion 314, heat $Q_L$ is transferred through the central hub 3452 and the rear arms 3453 to the back plate 343 and then the seals 162. Transferring the heat $Q_L$ through the central hub 1452, 2452, 3452 and the rear arms 1453, 2453, 3453 to the back plate 143, 243, 343 increases the operating efficiency of the display case 10 because the heat load, which is a function of heat $Q_L$, is not transferred into the refrigerated space 12. Display cases have the illuminated mullion 14, 214, 314 are far more efficient than display cases with a conventional illumination assembly (often referred to as a "cooler stick") which transfer the heat load into the refrigerated space which then must be dealt with by the refrigeration components. For example, the condenser pump (with an efficiency of 45%) consumes 145 watts to remove 100 watts generated by the conventional illumination assembly. By transferring the heat load (and the heat $Q_L$) to the back plate 143, 243, 343 for heating of the seals 162 and not into the refrigerated space 12, the inventive display cases 10 reduces the consumption of energy by the condenser pump which increases the operating efficiency of the case 10 and the life of the pump.

The heat $Q_L$ may be combined with the heat $Q_H$ generated by the heating element 147 to further warm the back plate 143, which in turn warms the seals 162. Essentially, heat from two different sources—the heat $Q_L$ generated by the LEDs 1401 and the heat $Q_H$ generated by the element 147—can be utilized, depending upon the operating conditions of the display case 10 to warm and maintain the integrity of the seals 162. Due to the contribution of heat $Q_L$ provided from the LEDs 1401 and transferred by the internal support 145, considerably less heat $Q_H$ is required from the element 147 to attain the total heat $Q_T$ needed to warm the seals 162 and prevent condensation on the door frame 160 and glass 161. Consequently, the energy consumption of the heating element 147 is reduced and the efficiency of the display case 10 is increased. Therefore, the method of heating the seal 162 to maintain its suitable temperature involves contributions from distinct sources, the heat $Q_L$ generated by the LEDs 1401 and transferred by the internal support 145, and the heat $Q_H$ generated by the element 147. The total heat total heat $Q_T$ corresponds to the amount of heat transferred by the back plate 143 to the seals 162.

The method of heating the seals 162 is affected by the operating conditions of the display case 10 and the illumination assembly 1400. In a first operating mode of the method, when the store or building in which the display case 10 is open for business and the illumination assembly 1400 is operational to illuminate the display case 10, the heat $Q_L$ provided from the LEDs 1401 is sufficient to heat the seals 162 without any contributions from the element 147 (wherein heat $Q_H$ is zero). Thus, the total heat is defined as $Q_T=Q_L$ in order to heat the seals 162 and prevent condensation on the door frame 160 and glass 161. In a second operating mode of the method, when the store or building is closed and the illumination assembly 1400 is not operational, the heat $Q_L$ provided from the LEDs 1401 is essentially zero and the heater element 147 is operated to provide heat $Q_H$ to warm the seals 162. In this operating mode, where the heater element 147 consumes approximately 100 watts, the total heat reduces to $Q_T=Q_H$. In a third operating mode of the method, when the store is open and the illumination assembly 1400 is generating a reduced amount of heat $Q_L$ (compared to the heat generated in the first operating mode), the heater element 147 can be operated at a reduced level or throttled to provide a relatively small contribution of heat $Q_H$ (compared to the heat generated in the second operating mode, e.g. 10-20 watts versus 100 watts in the second mode). Thus, the total heat is defined as $Q_T=Q_L+Q_H$ (where $Q_L$ exceeds $Q_H$) in order to heat the seals 162 and prevent condensation. The third operating mode can result from the use of a dimmer and/or a motion detection system that adjusts the output of the illumination assembly 1400 based upon pre-set conditions, including the presence or absence of customers near the display case 10.

Figure 5:
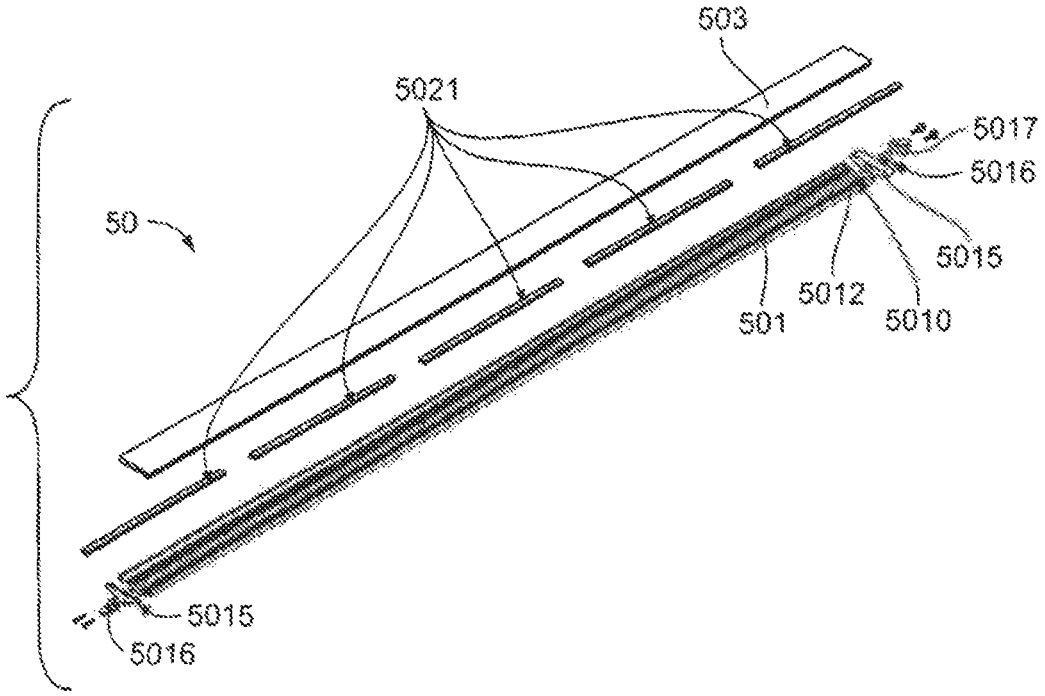
FIG. 5 is an exploded view of a first LED fixture suitable for retrofit to a center mullion in a display case.
Figure 6:
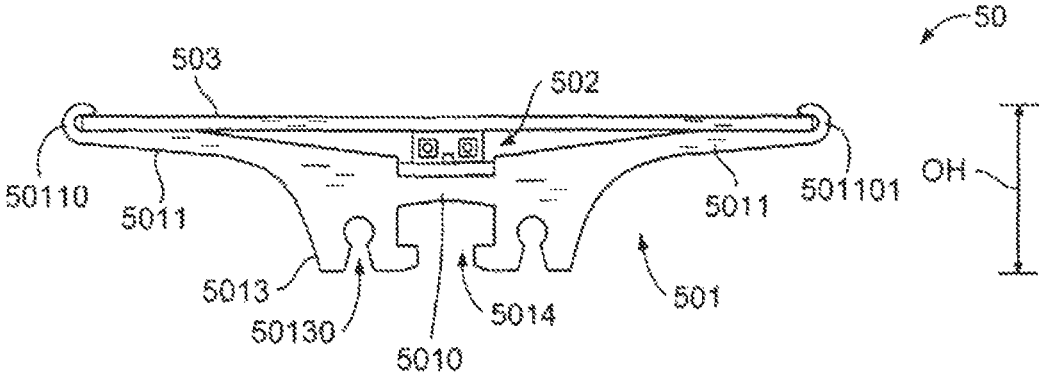
FIG. 6 is an end view of the LED fixture of FIG. 5.
Figure 7:
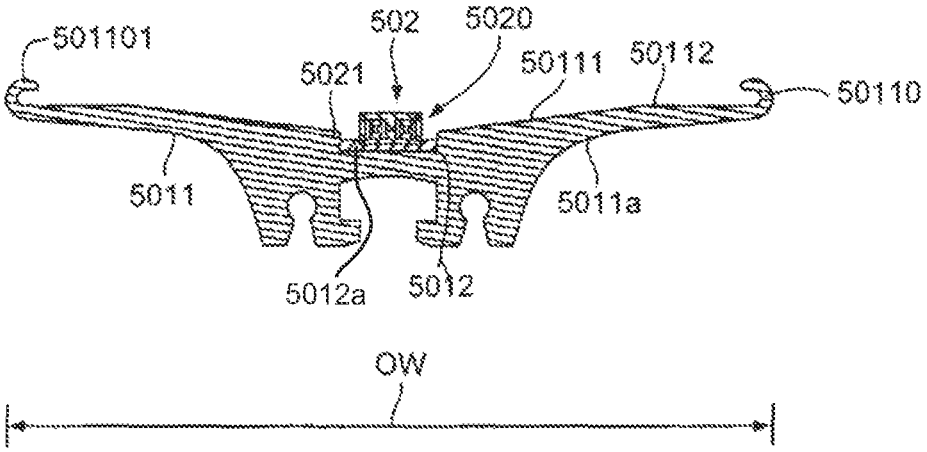
FIG. 7 is cross section of the LED fixture of FIG. 5.

FIGS. 5-7 show an alternate low-profile, elongated LED fixture 50 that is configured to be secured to an existing center frame member or center mullion within a display case or walk-in cooler, in a retrofit manner. The center fixture 50 includes an elongated frame or housing 501, a light engine or illumination assembly 502 comprised of at least one light emitting diode (LED) 5020 electrically and mechanically connected to a printed circuit board (PCB) 5021, and a substantially planar lens or cover 503. Referring to FIGS. 6 and 7, the support frame 501 includes a central hub 5010 and a pair of outwardly and upwardly extending arms 5011. Preferably, the PCB 5021 is partially received within a channel 5012 of the central hub 5010. The channel 5012 has a recessed depth of 0.05 to 0.07 inch, and preferably 0.06 inch. The arms 5011 provide a reflecting surface for light generated by the LEDs 5020 through the lens 503 and into the refrigerated space in order to evenly illuminate the food and/or beverage products therein. At least one rear leg 5013 extends from the central hub 5010 and includes an elongated recess 50130 that receives a projection or lip of the mullion to enable coupling of the fixture 50. In the embodiment of FIGS. 5-7, the rear legs 5013 depend from the central hub 5010 to define a central cavity 5014 that is configured to receive a fastener for securement of the fixture 50 to the mullion within the display case. Preferably, the cavity 5014 extends along the length of the frame 501. The central cavity 5014 is substantial with a depth from the edge of the legs 5013 to the central hub 5010 that is 0.175 to 0.225 inch, and preferably is 0.2 inch, and a width of 0.3 to 0.4 inch, and preferably 0.320 inch.

As shown in FIGS. 6 and 7, each arm 5011 has a curvilinear terminus 501101 that defines a receiver 50110 that receives an edge of the lens 503 for securement of same without a fastener. The arm 5011 includes a curvilinear lower surface 5011*a*, while the upper surface comprise two linear segments—an inner linear surface segment 50111 and an outer linear surface segment 50112, the latter being substantially parallel to the bottom wall 5012*a* of the channel 5012. Preferably, the inner linear segment 50111 is polished or buffed to provide a coefficient of reflection of 85 to 95, while the outer linear segment 50112 is not similarly polished. The inner linear segment 50111 is inclined with an angle ranging from 5 to 15 degrees from horizontal, and is preferably 6 to 10 degrees from horizontal, and most preferably 7 to 8 degrees from horizontal (wherein the angle is defined by a horizontal reference line that is parallel to a bottom wall of the channel 5012). The angle between the inner linear segment 50111 and the outer linear segment 50112 is 180 to 190 degrees, preferably 185 to 190 degrees, and most preferably 187 degrees. These angles are optimized based upon the performance characteristics of the illumination assembly 502, namely the LEDs 5020. The inner and outer linear segments 50111, 50112, the terminus 501101 and the receiver 50110 all reside above the central hub 5010. Since the fixture 50 includes symmetric arms 5011 to evenly distribute light from left to right and throughout the display case 10, it is configured to be joined to a center mullion or support frame. Once coupled to the mullion or support frame, the LED support fixture 50 functions in a manner similar to that described above to transfer heat from the illumination assembly 502 to heat the door seal(s) and reduce energy consumption of the heating element, and thereby increase the efficiency of the display case 10. Due to the inclined span of the symmetric arms 5011, the frame 501 has a "low-profile" configuration with an overall height OH (see FIG. 6), which is defined as the distance between the lowermost edge of the rear legs 5013 and the uppermost edge of the receiver 50110, that is 0.5 to 0.7 inch, preferably 0.5 to 0.6 inch, and most preferably 0.535 inch. Also due to the span of the arms 5011, the frame 501 has an overall width OW (see FIG. 7), which is defined as the distance between the outermost surface of the receivers 50110, of 2 to 3 inches, preferably 2.25 to 2.75 inches, and most preferably 2.5 inches. Thus, the aspect ratio, meaning the ratio of the most preferred width to height of the fixture 50 is 2.5:0.535 or 4.67, which facilitates installation of the fixture 50 without interfering with the operation of the display case. In addition, the lowermost edge of the inner linear segment 50111 is 0.06 inch above the bottom wall 5012*a* of the channel 5012, which bounds the upper extent of the central hub 5010. The low-profile configuration of the fixture 50 ensures that the fixture 50 does not compromise the ingress and egress of display case 10 once the fixture 50 is retrofitted to a mullion or support member of the case 10.

As shown in FIG. 5, the illumination assembly 502 includes multiple PCBs 5021 electrically joined inline by a connector. Preferably, each PCB 5021 includes a plurality of LEDs 5020, which may be Nichia NS6W083 or Citizen CL-820 or CL-822 LEDs. In one embodiment of the fixture

50 having 30 LEDs 5020 arranged in five parallel groups of six serial LEDs 5020, wherein each group includes a resistor. The fixture 50 is connected to a low voltage power source and a bridge rectifier, an arrangement of four diodes in a bridge configuration that provides the same polarity of output voltage for either polarity of input voltage, is positioned between the power source and the arrangement of LEDs 5020. The bridge rectifier converts alternating current (AC) input into direct current (DC) output to provide full-wave rectification from a two-wire AC input. Referring to FIG. 5, the fixture 50 includes an end cap 5015 that include at least one aperture that receives an elongated fastener 5016 that is also received by the recess 50130 to secure the end cap 5015 to the frame 501. The end cap 5015 also includes at least one opening that receives leads 5017 from an external, low voltage power supply (not shown).

Figure 8:
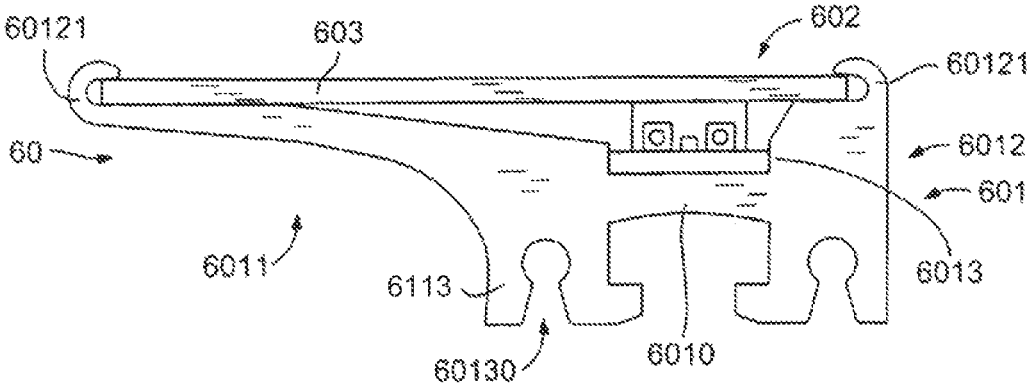
FIG. 8 is an end view of a second LED fixture suitable for retrofit to an end mullion in a display case.
Figure 9:
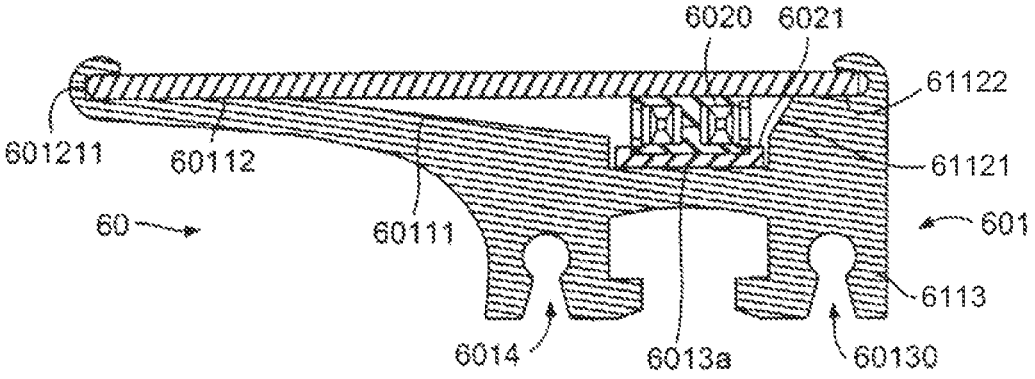
FIG. 9 is a cross-section of the LED fixture of FIG. 8.

FIGS. 8 and 9 show an alternate LED support fixture 60 configured to an existing corner frame member or end mullion within a display case or walk-in cooler, in a retrofit manner. The fixture 60 includes an elongated support frame 601, an illumination assembly 602 (similar to illumination assembly 1400 and 502) comprised of at least one light emitting diode (LED) 6020 electrically and mechanically connected to a printed circuit board (PCB) 6021, and lens or cover 603. The support frame 601 includes a central hub 6010, an outwardly extending arm 6011 and a shoulder segment 6012, which have a curvilinear terminus 60121 that defines a receiver 601211 that receives an edge of the lens 603 for securement of same without a fastener. The arm 6011 and shoulder 6012 provide a reflecting surface for light generated by the LEDs 6020 through the lens 603 and into the refrigerated space 12 in order to evenly illuminate the food and/or beverage products therein. The arm 6011 includes an inner linear segment 60111 and an outer linear segment 60112, the latter being substantially parallel to the bottom wall 6013*a* of the channel 6013. The inner linear segment 60111 provides a reflecting surface that ranges from 0 to 60 degrees from horizontal, preferably 10-15 degrees from horizontal, and most preferably 12 degrees. The angle between the inner linear segment 60111 and the outer linear segment 60112 is 180 to 190 degrees, preferably 185 to 190 degrees, and most preferably 187 degrees. The shoulder 6012 includes an inner linear segment 61121 extending from the channel 6013 and an outer linear segment 61122, wherein the angle between the inner linear segment 61121 and the outer linear segment 61122 is substantially 120 degrees. The inner linear segment 61121 provides a reflecting surface and is oriented substantially 60 degrees from horizontal. These angles are optimized based upon the performance characteristics of the illumination assembly 602, namely the LEDs 6020.

At least one rear leg 6113 extends from the central hub 6010 and includes an elongated recess 60130 that receives a fastener to secure an end cap to the fixture 60. In the embodiment of FIGS. 8 and 9, the rear legs 6113 depend from the central hub 6010 to define a central cavity 6014 that is configured to receive a fastener for securement to the end mullion within the display case 10. Once coupled to the end mullion or end support frame, the LED support fixture 60 functions in a manner similar to that described above to transfer heat from the illumination assembly 602 to heat the door seal(s) and reduce energy consumption of the heating element, and thereby increase the efficiency of the display case. Due to the inclined span of the arms 6011 and the shoulder 6012, the frame 601 has a "low-profile" configuration with an overall height OH that is 0.5 to 0.7 inch, preferably 0.5 to 0.6 inch, and most preferably 0.535 inch. Also due to the span of the arm 6011 and the shoulder 6012, the frame 601 has an overall width OW, which is the distance between the outermost surface of the receivers 601211, of 1.5 to 2 inches, preferably 1.5 to 1.75 inches, and most preferably 1.7 inch. Thus, the aspect ratio, meaning the ratio of the most preferred width to height of the fixture 60 is 1.7:0.535 or 3.17, which facilitates installation of the fixture 60 in the corner of the display case without interfering with its operation.

The illuminated mullion 14 and the LED support fixture 50, 60 may include a controller including a motion sensor, for example an optical sensor or an acoustical sensor, and/or temperature sensor, for example a thermocouple, that measures the internal temperature of the refrigerated space 12 within the display case 10. When the motion sensor detects the presence of people near the display case 10, then the controller increases the output of the illumination assembly 1400, 502, 602. Similarly, when the motion sensor no longer detects the presence of people near the display case 10, then the controller decreases, either partially (e.g., dimming) or fully, the output of the illumination assembly 1400, 502, 602. When the temperature sensor detects an internal temperature that exceeds a preset threshold, a controller linked to the sensor reduces the output of the illumination assembly 1400, 502, 602, either partially (e.g., dimming) or fully, to increase the operating life of the assembly 1400, 502, 602. An example of this situation occurs when the compressor within the display case 10 is shut off for maintenance of the case 10.

In addition, the illuminated mullion 14 and the LED support fixture 50, 60 may include a wired or wireless module, primarily a radio frequency control unit, that allows for remote control of the illumination unit and/or the heating element. The radio frequency control unit can be factory assembled into the housing as original equipment, or added to the housing or frame in the field by a service technician. In general terms, the radio frequency control unit allows an operator to remotely turn on, turn off, or adjust (e.g., dim) the illumination assembly of a single unit or a group of units to any desired brightness/output level. The remote interaction resulting from the control unit provides a number of benefits to the invention, including longer operating life for the components, lower energy consumption, and lower operating costs. The radio frequency control unit may also include high and low output switches or settings.

The radio frequency control unit comprises a number of components including a transceiver (or separate receiver and transmitter components), an antenna, and control interface for a power supply. The control interface includes a connector containing input signals for providing raw power to the control unit, as well as output signals for controlling the power supply itself. In operation, the control unit interacts with the power supply to allow an operator to power on, power off, or dim the brightness of the fixture. To ensure reception of the operating signals, the control unit utilizes an embedded antenna, or an external antenna coupled to the housing for better wireless reception. The radio frequency control unit can receive commands from a centralized controller, such as that provided by a local network, or from another control module positioned adjacent a mullion in close proximity. Thus, the range of the lighting network could be extended via the relaying and/or repeating of control commands between control units.

In a commercial facility or building having multiple refrigerated display cases 10 or walk-in coolers, each inventive mullion 14 may be assigned a radio frequency (RF) address or identifier, or a group of mullions 14 are assigned the same RF address. An operator interfacing with a lighting control network can then utilize the RF address to selectively control the operation and/or lighting characteristics of all mullions 14, a group of mullions 14, or individual mullions 14 (or display cases 10) within the store. For example, all mullions 14 having an RF address corresponding to a specific function or location within the store, such as the loading dock or shipping point, can be dimmed or turned off when the store is closed for the evening. The operator can be located within the store and utilize a hand held remote to control the group of mullions 14 and/or individual mullions 14. Alternatively, the operator may utilize a personal digital assistant (PDA), a computer, or a cellular telephone to control the mullions 14. In a broader context where stores are located across a broad geographic region, for example across a number of states or a country, the mullions 14 in all stores may be linked to a lighting network. A network operator can then utilize the RF address to control: (a) all mullions 14 linked to the network; (b) the mullions 14 on a facility-by-facility basis; and/or (c) groups of mullions 14 within a facility or collection of facilities based upon the lighting function of the mullions 14.

A centralized lighting controller that operably controls the mullions 14 via the control units can be configured to interface with an existing building control system or lighting control system. The central lighting controller may already be part of an existing building control system or lighting control system, wherein the mullions 14 and the control unit are added as upgrades. The radio frequency control unit could utilize a proprietary networking protocol, or use a standard networking control protocol. For example, standard communication protocols include Zigbee, Bluetooth, IEEE 802.11, Lonworks, and Backnet protocols.

Figure 10:
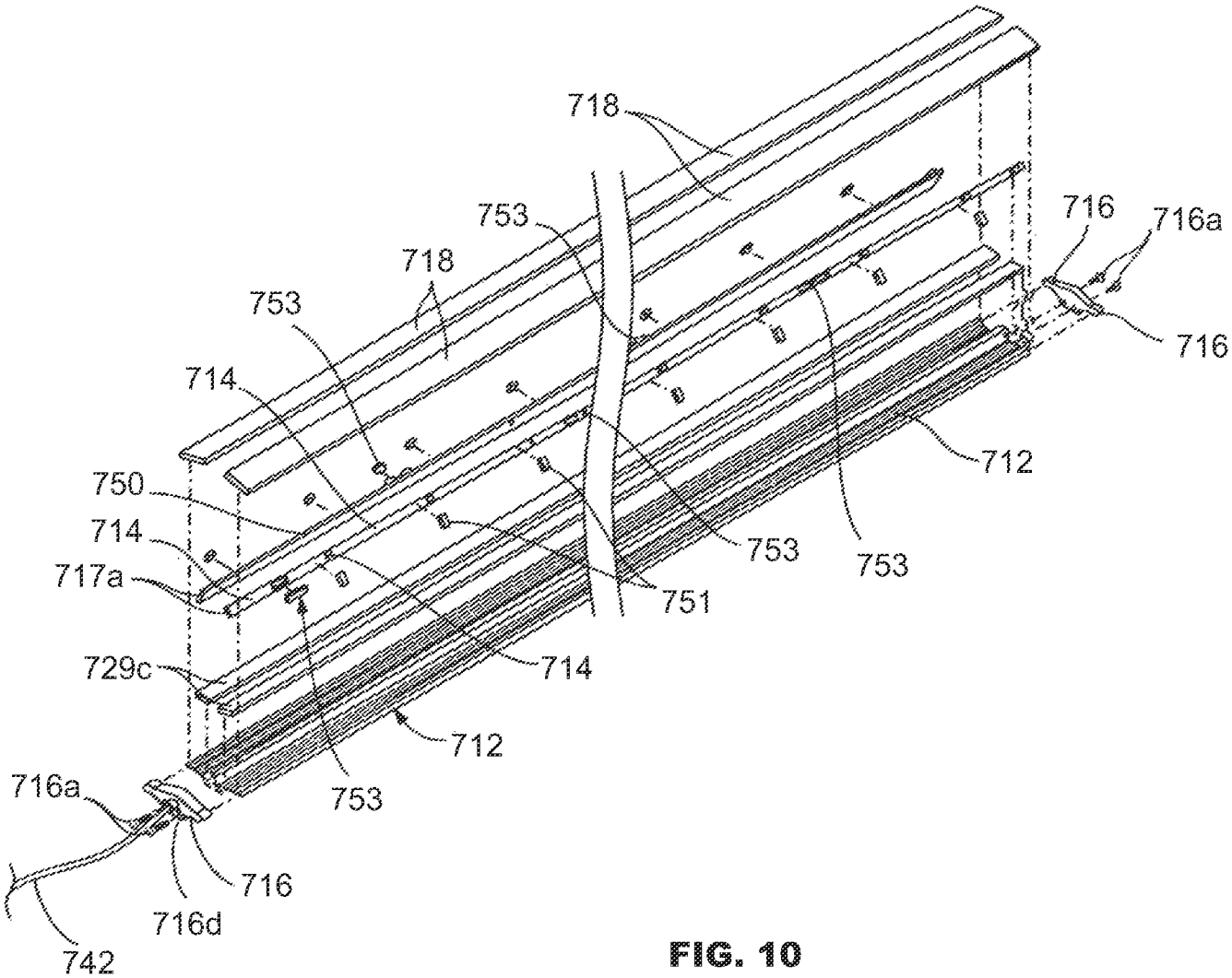
FIG. 10 is an exploded view of a light fixture.
Figure 11:
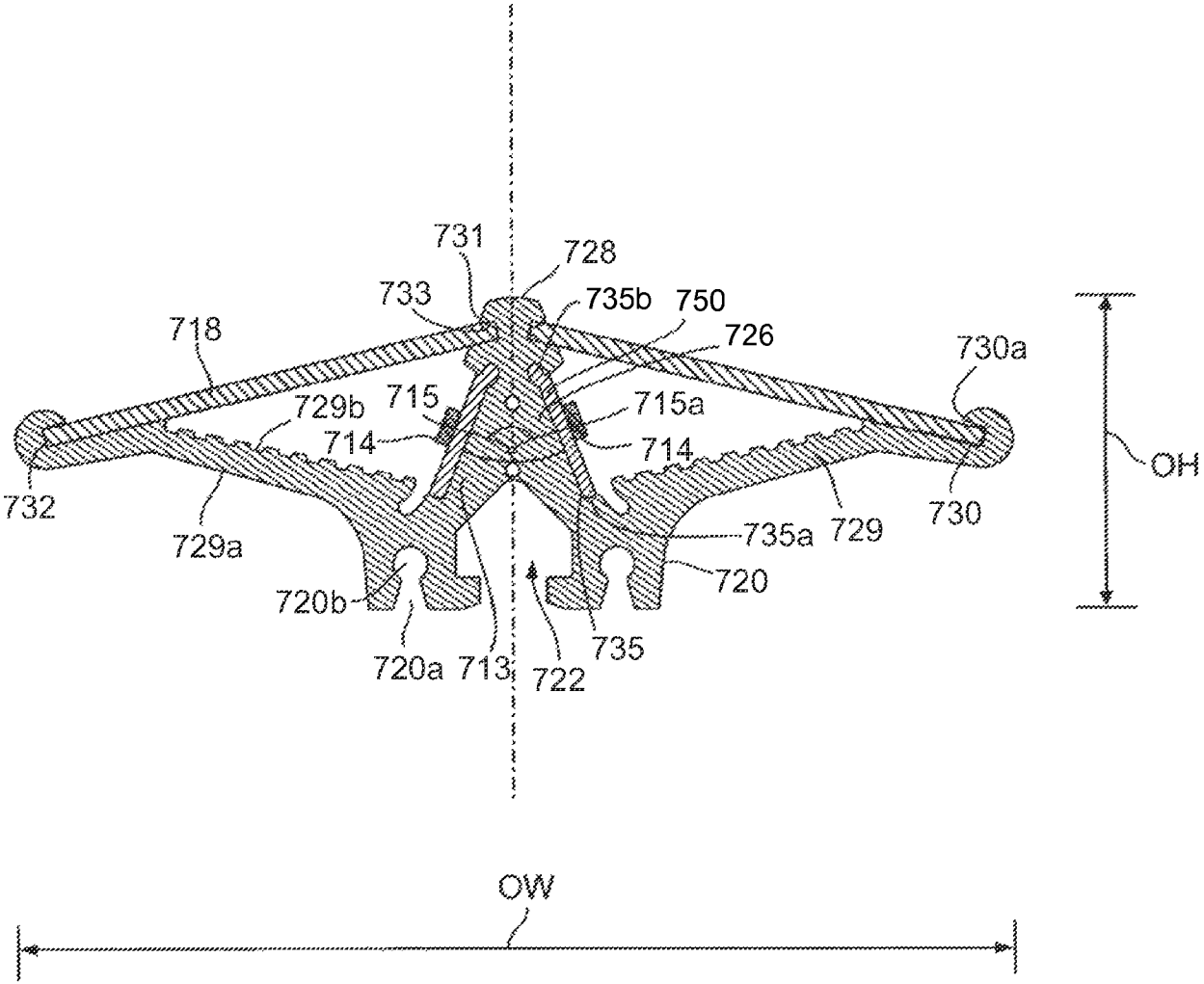
FIG. 11 is a sectional view of a frame of the light fixture of FIG. 10, showing a pair of angled support members extending upward to form a peak.

FIGS. 10-11 show an LED illuminated support fixture 710 of the present invention that is configured to be secured to an existing frame member or mullion within a display case or walk-in cooler, in a retrofit manner. Conventional refrigerated display cases are disclosed in U.S. Pat. Nos. 6,637,093 and 6,606,833. The fixture 710 comprises an elongated housing or frame 712, at least two light emitting diodes (LEDs) 714 electrically and mechanically connected to a printed circuit board (PCB) 750, angularly mounted within the frame 712, opposed end caps 716, and generally transparent cover portions 718 that couple to the frame 712 and extend between the end caps 716. As explained in greater detail below, the fixture 710 includes two groups of uniquely positioned LEDs 714 that improve the operating performance of the fixture 710 while lowering the material and assembly costs of the fixture 710. As shown in FIG. 10, the fixture 710 includes multiple PCBs 750 electrically joined inline by a connector 753. Since the support fixture 710 of FIGS. 10-11 includes symmetric arms 729 to evenly distribute light from left to right, it is configured to be joined to a center mullion or support frame 712. Due to the inclined span of the arms 729, the frame 712 has a "low-profile" configuration with an overall height OH (see FIG. 11), which is the distance between the uppermost surface of the central post 728 and the lowermost surface of the rear legs 720, that is 0.0.8 to 1 inch, preferably 0.8 to 0.9 inch, and most preferably 0.85 inch. Also, due to the span of the arms 729, the frame 712 has an overall width OW (see FIG. 11), which is the distance between the outermost surface of the curvilinear receivers 730, of 2 to 3 inches, preferably 2.5 to 3 inches, and most preferably 2.75 inches. Thus, the aspect ratio, meaning the ratio of the most preferred width to height of the fixture 712 is 2.75:0.85 or 3.23, which facilitates installation of the fixture 710 without interfering with the operation of a display case.

Referring to the sectional view of FIG. 11, the frame 712 includes at least one rear leg 720 and has a recess 720*a* configured to receive and/or engage an existing frame member or mullion within the display case. The rear legs 720 extend from a central region 713 of the frame 712. The central region 713 includes angled support member or rib 726. Described in a different manner, the angled support member 726 extends upward from the central region 713 above each rear leg 720. The support members 726 converge at the central post 728, which defines an uppermost extent of the frame 712. The rear legs 720 are spaced a distance apart to define a generally U-shaped central cavity 722 that extends longitudinally along the length of the frame 712. The central cavity 722 is designed to receive a fastener or projection of the frame member or mullion to enable coupling of the fixture 710 thereto. Preferably, the frame 712 is a unitary element wherein the rear legs 720, the support members 726 and the central post 728 define a single, integral frame 712 that is preferably extruded from aluminum. Alternatively, the rear legs 720, the support members 726 and/or the central post 728 are separate pieces that are joined, for example by weldment, to form the frame 712. The support members 726 define an internal arrangement angle θ that ranges from 30 to 100 degrees, preferably 45 to 75 degrees and most preferably 60 degrees. As explained below, the arrangement angle θ of the support members 726 relates to the angular positioning of the LEDs 714. Described in a different manner, the first support member 726 resides in a first plane and the second support member 726 resides in a second plane, wherein the first and second planes are angled in a manner that corresponds to the internal arrangement angle θ. A vertical center line CL (see FIG. 11) bisects the central post 728 and separates the frame 712 into two halves. Therefore, the frame 712 is symmetric about the center line CL.

Extending from each angled support member 726, the frame 712 has a pair of opposing arms 729 that extend from the central region 713. Each arm 729 includes a curvilinear lower surface 729*a* and an upper surface 729*b*, the latter of which provides a reflecting surface for light generated by the LEDs 714 through the cover 718 and into the refrigerated space in order to evenly illuminate the food and/or beverage products therein. The upper arm surface 729*b* has a notched surface to facilitate the connection with a reflecting surface (not shown), such as a mirror panel. The upper arm surface 729*b* and the reflecting surface are angularly oriented in a range of 0 to 60 degrees from horizontal, and is preferably 10-15 degrees from horizontal, and most preferably 12 degrees from horizontal. At an upper end portion or terminus, each arm 729 includes a curvilinear receiver 730 that receives a first edge 732 of a lens cover 718. The center post 728 includes a second recess 731 that receives a second edge 733 of the lens cover 718 for securement of the cover 718 to the frame 712. In this manner, the both lens covers 718 depend downwardly at an angle from the center post 728. Preferably, the curvilinear receiver 730 of the arm 729 and the second recess 731 of the top post 728 extend longitudinally along the length of the frame 712. The curvilinear receiver 730 is defined by a curvilinear flange 730*a* of the arm 729. As shown in FIG. 11, the central post 728 defines the uppermost component of the fixture 710, wherein all other components reside below the post 728. The receiver 730 vertically resides below the recess 733 of the post 728 and above the uppermost extent 720*b* of the recess 720*a*.

Preferably, the frame 712 is an aluminum extrusion and the lens cover 718 is U.V. stabilized polycarbonate. A polycarbonate cover 718 provides electrical isolation for the internal components, including the LEDs 714, while allowing most of the light energy produced by the LEDs 714 to pass through the cover 718. The cover 718 may be clear, diffused, or colored depending upon the desired lighting results. In one preferred embodiment, the frame 712 has an overall length of approximately 60 inches, and the cover 718 has a thickness of approximately 0.050 inch.

Figure 12:
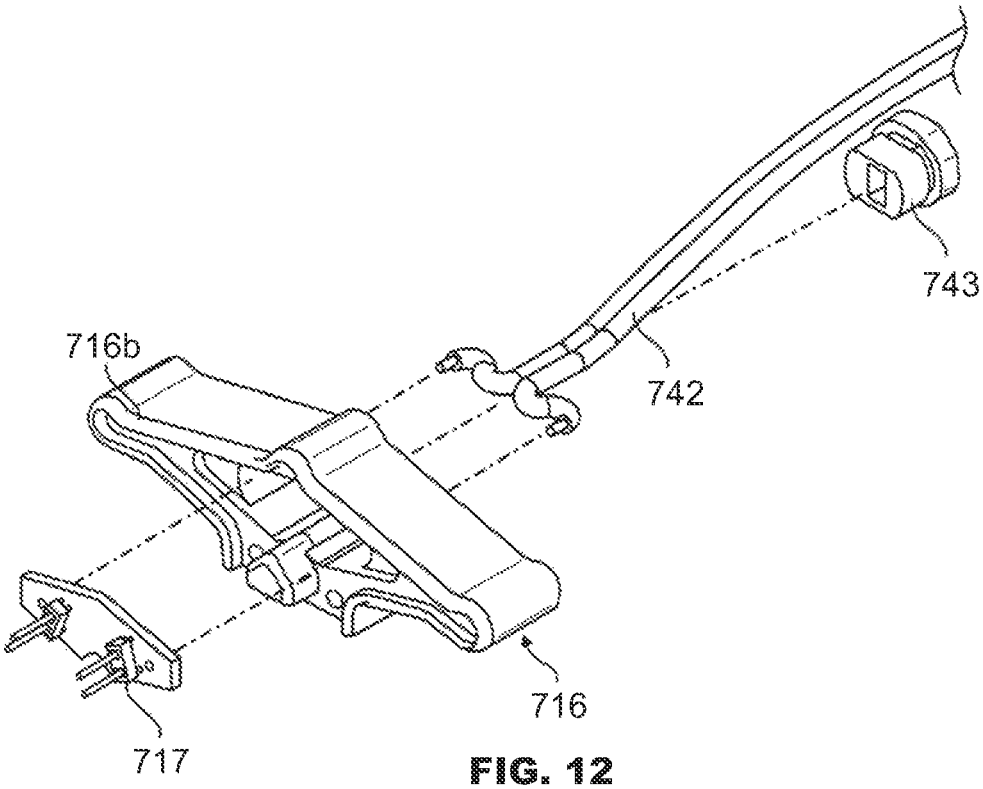
FIG. 12 is an exploded perspective view of an end cap of the light fixture of FIG. 10.

Referring to FIGS. 10 and 12, the end caps 716 are removably affixed to the longitudinal ends of the frame 712 by at least one elongated connector 716*a*, such as a threaded fastener or pin. The end cap 716 has a flange 716*b* that overlaps an extent of the end portion of the frame 712. Alternatively, the flange 716*b* is omitted and a main body portion 716*d* of the end cap 716 is substantially planar. One of the end caps 716 includes an electrical connector 717, such as a male plug, for a power lead or cord 742, preferably universal alternating current (AC) input (such as 85-260 Volts, 47-63 Hertz), leading to a power supply. The end cap 716 may also have a securement nut 743 to secure the power cord 742 to the end cap 716 to prevent the power cord 742 from being accidentally pulled out of the end cap 716 thereby disconnecting the power supply from the fixture 710. Alternatively, the electrical connector 717 is omitted and the power cord 742 extends through the end cap 716 whereby the cord 742 is "hard-wired." In another embodiment, one of the end caps 716 includes either an aperture or a connector 717 for the power cord 742 and the other end cap 716 includes a connector 717 such that multiple fixtures 710 can be electrically interconnected without the use of additional external wires or leads. For example, a first fixture 710 includes a first connector 717 for the power cord 742 and a second end cap 716 with a female receptacle 717. A second fixture 710 includes a first end cap 716 with a male plug connector 717 that mates with the female receptacle 717 of the first fixture 710, whereby the first and second fixtures 710 are electrically interconnected for operation. The ability to directly interconnect the fixtures 710 without using separate leads or wires increases the versatility and utility of the fixture 710 since fewer components are necessary.

The fixture 710 includes at least one external power supply that can be utilized to power the fixture components without diminishing the fixture's "low-profile" configuration. Preferably, the power supply features universal input which allows the fixture 710 to be used in any electrical grid around the world. The power supply is a high-efficiency unit that provides constant current output (meaning direct current (DC)) in order to uniformly energize the LEDs 714. High-efficiency may be obtained by utilizing a switching type power supply design. The power supply may also have power factor correction capability and built-in electromagnetic interference (EMI) filtering to reduce and/or eliminate noise and distortion from the electrical grid. The fixture 710 may include a single power supply to power both groups of LEDs 714, or a power supply for each group of LEDs 714. The power supply may be an open frame type or an enclosed type with an outer frame or case, where the open frame type may include a coil. The power supply also provides constant current levels through a printed circuit board 750 to the LEDs 714 mounted to the PCB 750.

The fixture 710 includes two groups of multiple LEDs 714, wherein a first group of LEDs 714 is mounted to one of the support members 726 and a second group of LEDs 714 is mounted to the other support member 726. Because the support members 726 are angularly positioned, the grouping of LEDs 714 connected to the support members 726 are also angled from each other. Described in a different manner, and in contrast to conventional fixtures, the first group or array of LEDs 714 is angularly positioned with respect to the second group or array of LEDs 714, which enhances the range of light distribution without the need for additional lenses within the fixture 710. Preferably, the LEDs 714 are oriented substantially perpendicular to the support member 726, wherein a longitudinal axis 715 of the left LED 714 (representing the first group of LEDs) is substantially perpendicular to the respective support member 726 and a longitudinal axis 715*a* of the right LED 714 (representing the second group of LEDs) is substantially perpendicular to the respective support member 726. Each group of LEDs 714 extend along the length of the support member 726, and thus the length of the fixture 710. When the fixture 710 is vertically oriented, the LEDs 714 of one group may be horizontally aligned with the LEDs 714 of the second group, or horizontally misaligned such that a continuous line connecting the LEDs 714 of both groups is staggered. The longitudinal axis 715 of the left LED 714 (representing the first group of LEDs) intersects the longitudinal axis 715*a* of the right LED 714 (representing the second group of LEDs) to define a LED intersection angle $\Phi$. The LED intersection angle $\Phi$ is a function of the support member internal arrangement angle $\theta$, where the sum of the LED intersection angle $\Phi$ and the internal arrangement angle $\theta$ equals 180 degrees. In the embodiment of FIG. 11, where the support member internal arrangement angle $\theta$ is approximately 60 degrees, the LED intersection angle $\Phi$ is approximately 120 degrees. Due to the angular positioning of the LEDs 714 and the arms 729, the fixture 710 provides a light range of approximately 180 degrees.

Figure 13A:
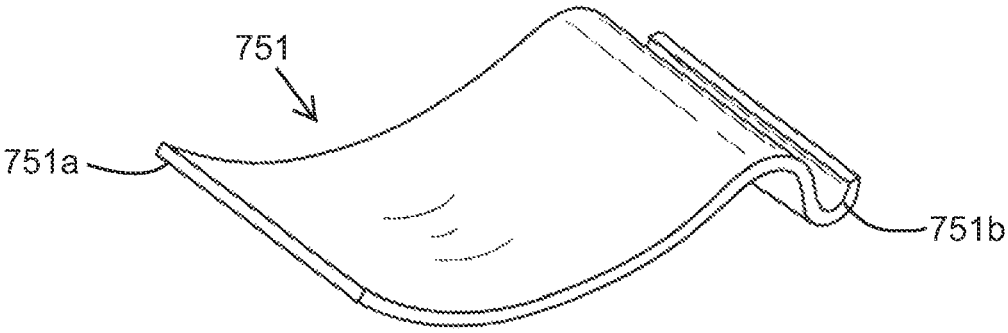
FIG. 13A is a perspective view of a tension clip used to secure a printed circuit board to an angled support member of the light fixture of FIG. 10.
Figure 13B:
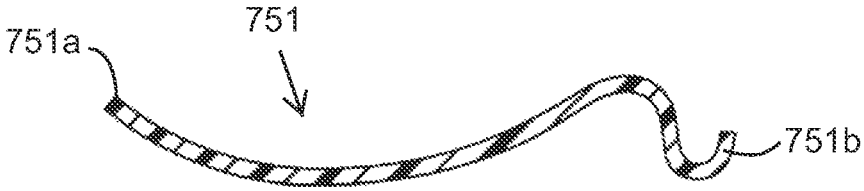
FIG. 13B is a cross-section of the tension clip of FIG. 13A.

Referring to FIGS. 10, 11, 14 and 15 each LED 714 is electrically and mechanically mounted to a printed circuit board (PCB) 750 that is removably affixed to the support member 726. Preferably, the PCB 750 is received by a channel 735 of the angled support member 726. The PCB 750 is retained against the angled support member 726 using a tension clip 751 (shown in FIGS. 13A and 13B). The tension clip 751 has a flat edge 751*a* and a curved edge 751*b*. The flat edge 751*a* is designed to fit in the lower edge 735*a* of the channel 735, and the curved edge 751*b* of the tension clip 751 is designed to fit in the upper edge 735*b* of the channel 735. Because of the curvature of the tension clip 751 and the flexibility of the metal it is constructed from, the PCB 750 is securely pressed against the support member 726 to retain the PCB 750 in its position. Depending upon the length of the mullion, multiple LEDs 714 are mounted to a number of PCBs 750 secured to the angled support member 726.

The PCB 750 has a receiver 717*a* to receive the electrical connector 717. The receiver 717*a* creates an electrical connection between the power cord 742 and the copper trace running throughout the PCB 750. The LED 714 is surface mounted to the PCB 750 using a pair of mounting pins connected to the LED 714. The board 750 includes a copper trace between the receiver 717*a* and the LED 714. Thus, the copper traces define a trace pattern that facilitates electrical connectivity across the PCB 750 and its components. A nylon bushing (not shown) may be positioned around the rear of the PCB 750 or the receiver 717*a* to function as an electrical insulator.

Within the PCB 750, current flows from the first pin 752 to the LED 714, across the LED 714, and then along the second mounting pin 754 back to the PCB 750, and then to a subsequent first pin 752 of another LED 714. If an LED 714 fails or upgrades are desired, the LEDs 714 can easily be removed to allow for the removal of the old LED 714 and installation of a replacement and/or upgraded LED 714. In one embodiment, the board 750 runs the entire length of the fixture 710 and a width of roughly 0.5 inch, and the LEDs 714 are warm white producing at least 30 Lumens (SI unit of luminous flux) per watt and with a color temperature ranging between 2,750 to 6,500 K and high color rendering index (CRI) of greater than 80. The CRI represents how a light source makes the color of an object appear to human eyes and how well subtle variations in color shades are revealed. The CRI is a scale from 0 to 100 percent indicating how accurate a "given" light source is at rendering color when compared to a "reference" light source, where the higher the CRI, the better the color rendering ability. In another embodiment, the board 750 may be limited to a length that is shorter that the length of the fixture 710. However, multiple boards 750 may be interconnected using the connector 717 to result in a length sufficient to cover the entire length of the fixture 710. In yet another embodiment, the fixture 710 includes fifteen (15) separate LEDs 714 positioned along each support member 726. One of skill in the art of LED fixture design recognizes that the number of LEDs 714 varies with the design parameters of the frame 712 and the support member 726. For example, a fixture 710 having a length of approximately 30 inches would have roughly one-half as many LEDs 714 mounted to each support structure 726.

The PCB 750 may be aluminum-clad or constructed from fiberglass. In the former construction, the aluminum-clad PCB 750 provides a thermal conductive path for heat generated by the LED 714 through the support member 726 to the rear legs 720 and the arms 729 for dissipation. In the latter construction where the PCB 750 is fiberglass (FR4), a thermally conductive interface element (not shown) is provided near the LED 714 to facilitate heat transfer to the support member 726 since fiberglass does not provide a thermal conductive path. Accordingly, a hole or aperture is formed in the fiberglass PCB 750 below the LED's 714 thermal slug to accommodate the interface element, which is in thermal contact with the LED 714 to facilitate heat transfer from an energized LED 714 to the support member 726. In general terms, the interface element is thermally conductive but electrically insulating. Further, the interface element is highly conformable and exerts a minimal amount of external stress upon the surrounding components, including the LED 714. During operation, heat generated by the LED 714 is transferred by the interface element through the PCB 750 to the support member 726 and then to the rear side support 720 and the arms 729 for dissipation. In one embodiment, the interface element is a generally circular pad formed from a low viscosity, non-electrically conductive gel or resin with high thermal conductivity and low thermal resistance properties. In another embodiment, the interface element is a thermally conductive liquid filler that is deformed to fill the void between the LED 714 and the support member 726 to which the PCB 750 is mounted. In either embodiment, the interface element does not exert measurable stress or force upon the LED 714. In another embodiment, the fiberglass PCB 750 includes a number of plated thru holes which reside under the LED 714 thermal slug, thereby acting a s "thermal vias" to transfer heat through the PCB 750. A thermal interface material is placed between the PCB 750 and the support member 726, which facilitates heat transfer from the lower portion of the PCB 750 to the support member 726, and also acts as an electrical insulator. This thermal interface material can be a die cut thermal pad, preferably round in shape, and large enough to cover or overlap the thermal vias in the PCB 750.

As evidenced by FIGS. 10-11, the fixture 710 includes a number of unique aspects. First, multiple LEDs 714 are electrically connected to a single PCB 750. Next, multiple PCBs 750 can be jointed to extend the substantially the length of the fixture 710. Connection points, connection pins 752, 754 and copper traces are utilized to electrically connect the various components, thereby eliminating the need for additional wires and connectors that increase the assembly time and build cost of the fixture 710. Furthermore, the two groups of LEDs 714 that are mounted on different planes provide a broader range of light than that provided by conventional fixtures having LEDs arranged in a single plane. The LEDs 714 are of the low wattage version, and may be Nichia NS6W083 or Citizen CL-820 or CL-822 LEDs.

Figure 14:
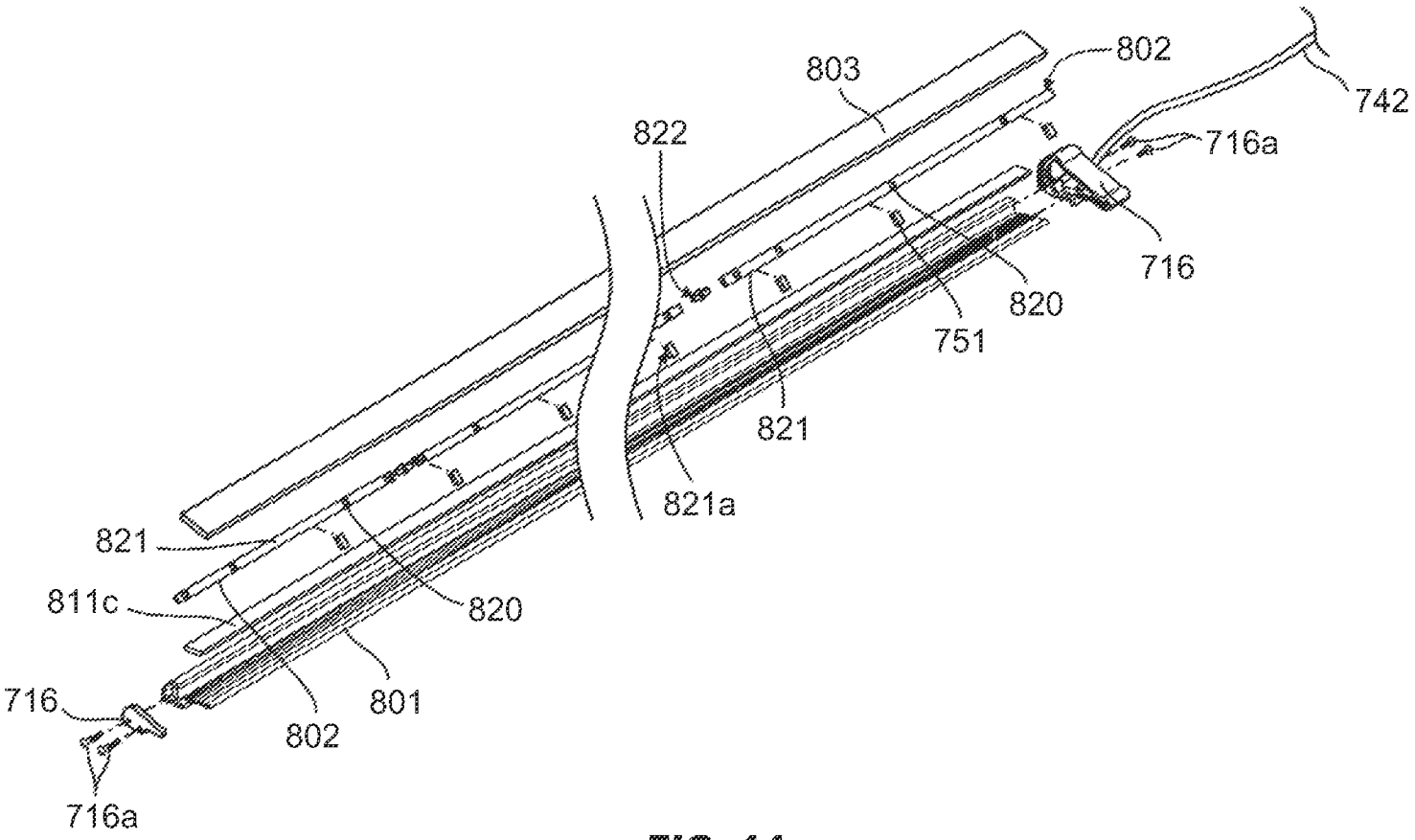
FIG. 14 is an exploded view of an alternate light fixture.
Figure 15:
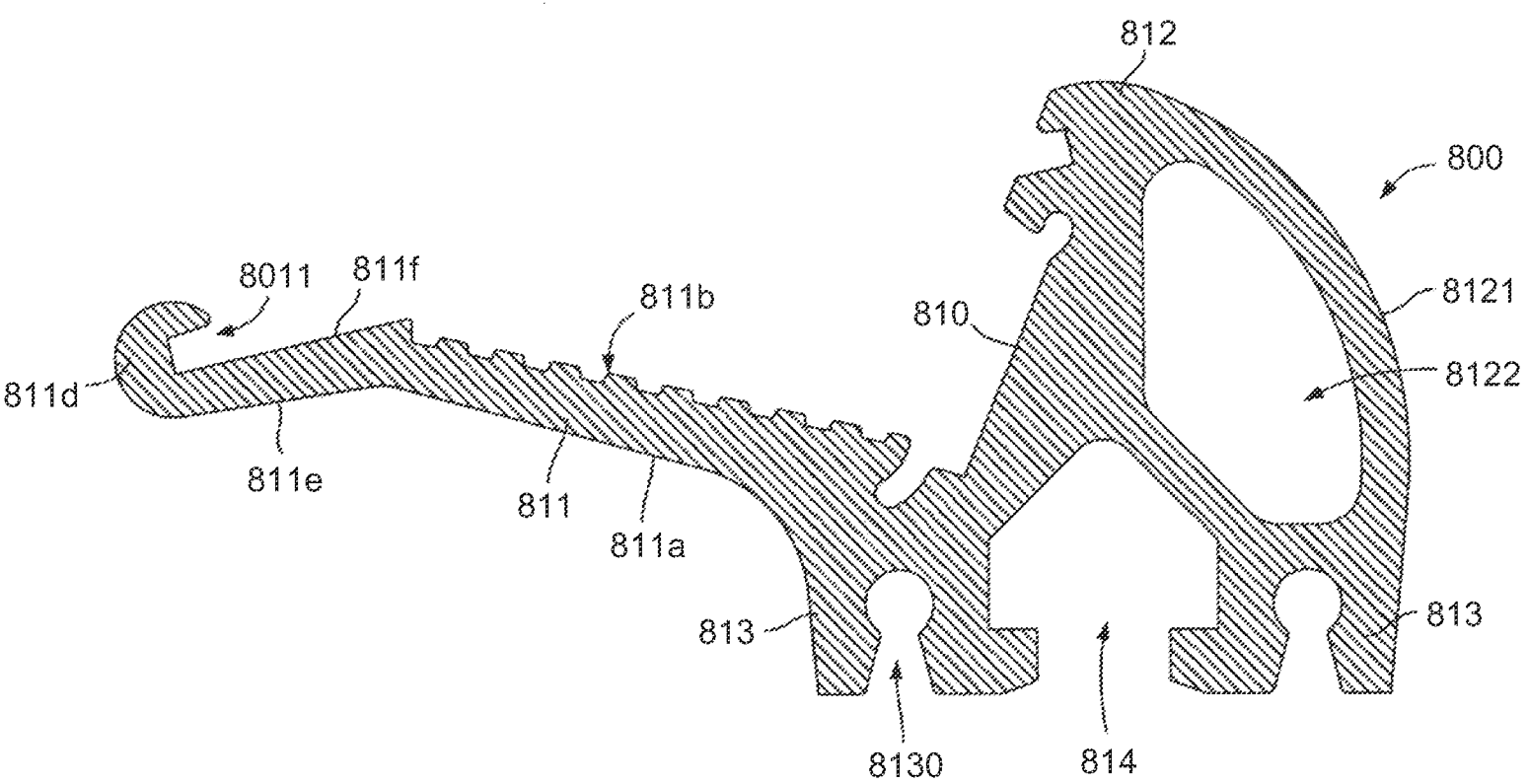
FIG. 15 is a cross-section of a frame of the light fixture of FIG. 14, showing an angled support member extending upward to form a peak.
Figure 16:
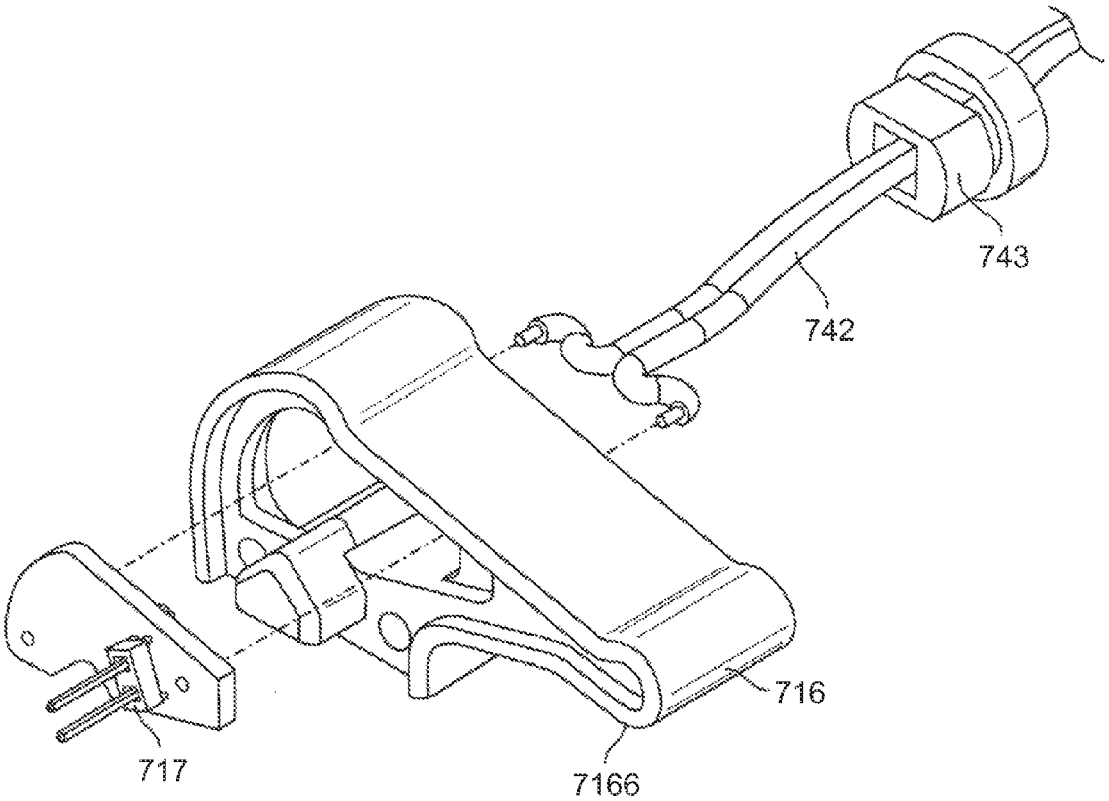
FIG. 16 is an exploded perspective view of an end cap of the alternate light fixture of FIG. 14.

FIGS. 14-16 show an alternate LED fixture 800 configured to an existing corner frame member or end mullion within a display case 10 or walk-in cooler, in a retrofit manner. The support assembly 800 includes an elongated support frame 801, an illumination assembly 802 comprised of at least one light emitting diode (LED) 820 electrically and mechanically connected to a printed circuit board (PCB) 821, and lens or cover 803. The support frame 801 includes a central hub 810, an outwardly extending arm 811 and a shoulder segment 812. The shoulder 812 includes a curvilinear outer edge 8121 and a interior aperture 8122 that extends along the longitudinal length of the frame 801. The arm 811 and shoulder 812 provide a reflecting surface for light generated by the LEDs 820 through the lens 803 and into the refrigerated space in order to evenly illuminate the food and/or beverage products therein. Each arm 811 includes a curvilinear lower surface 811*a* and an upper surface 811*b*, the latter of which provides a reflecting surface for light generated by the LEDs 820 through the cover 803 and into the refrigerated space in order to evenly illuminate the food and/or beverage products therein. The upper arm surface 811*b* preferably has a notched surface to facilitate the connection of a reflecting surface 811*c* (not shown), including a mirror panel. The upper arm surface 811*a* and the reflecting surface 811*c* are angularly oriented in a range of 0 to 60 degrees from horizontal, and is preferably 10-15 degrees from horizontal, and most preferably 12 degrees from horizontal. At an upper end portion or terminus 811*d*, each arm 811 includes a curvilinear receiver 8011 that receives a first edge 732 of a lens cover 718. Proximate the terminus 811*d*, the lower surface 811*a* includes a peripheral linear lower segment 811*e* and the upper surface 811*b* includes a peripheral linear upper segment 811*f*, both of which are preferably inclined relative to the lower surface 811*a* and upper surface 811*b*. As shown in FIG. 14, the illumination assembly 802 includes multiple PCBs 821 electrically joined inline by a connector 822

Rear leg 813 extends from the central hub 810 and includes an elongated recess 8130 that receives a fastener to secure an end cap to the fixture 800. In the illustrated embodiment, the rear legs 813 depend from the central hub 810 to define a central cavity 814 that is configured to receive a fastener for securement to the end mullion within the display case 10. Due to the inclined span of the arm 811 and the shoulder 812, the frame 801 has a "low-profile" configuration with an overall height OH that is 0.8 to 1 inch, preferably 0.8 to 0.9 inch, and most preferably 0.85 inch. Also, the frame fixture 800 has an overall width OW (see FIG. 11), which is the distance between the outermost surface of the curvilinear receiver 8011 and the outermost extent of the shoulder 812, of 1.5 to 2 inches, preferably 1.75 to 1.85 inches, and most preferably 1.8 inches. Thus, the aspect ratio, meaning the ratio of the most preferred width to height of the fixture 800 is 1.8:0.85 or 2.17, which facilitates installation of the fixture 800 in the corner of the display case 10 without interfering with its operation.

The LED fixtures 710, 800 may include a controller including a motion sensor, for example an optical sensor or an acoustical sensor, and/or temperature sensor, for example a thermocouple that measures the internal temperature of the refrigerated space within the display case 10. When the motion sensor detects the presence of people near the display case 10, then the controller increases the output of the LEDs 714, 820. Similarly, when the motion sensor no longer detects the presence of people near the display case 10, then the controller decreases, either partially (e.g., dimming) or fully, the output of the LEDs 714, 820. When the temperature sensor detects an internal temperature that exceeds a preset threshold, a controller linked to the sensor reduces the output of the LEDs 714 either partially (e.g., dimming) or fully, to increase the operating life of the LEDs 714, 820. An example of this situation occurs when the compressor within the display case 10 is shut off for maintenance of the case 10 and the temperature within the case 10 increases.

The LED fixtures 710, 800 may include a wired or wireless module, primarily a radio frequency control unit that allows for remote control of the illumination unit and/or the heating element. The radio frequency control unit can be factory assembled into the frame as original equipment, or added to the frame in the field by a service technician. In general terms, the radio frequency control unit allows an operator to remotely turn on, turn off, or adjust the illumination assembly of a single unit or a group of units to any desired brightness/output level. The remote interaction resulting from the control unit provides a number of benefits to the invention, including longer operating life for the components, lower energy consumption, and lower operating costs. The radio frequency control unit may also include high and low output switches or settings.

The radio frequency control unit comprises a number of components including a transceiver (or separate receiver and transmitter components), an antenna, and control interface for a power supply. The control interface includes a connector containing input signals for providing raw power to the control unit, as well as output signals for controlling the power supply itself. In operation, the control unit interacts with the power supply to allow an operator to power on, power off, or dim the brightness of the fixture. To ensure reception of the operating signals, the control unit utilizes an embedded antenna, or an external antenna coupled to the frame for better wireless reception. The radio frequency control unit can receive commands from a centralized controller, such as that provided by a local network, or from another control module positioned adjacent a mullion in close proximity. Thus, the range of the lighting network could be extended via the relaying and/or repeating of control commands between control units.

In a commercial facility or building having multiple refrigerated display cases or walk-in coolers, each inventive mullion may be assigned a radio frequency (RF) address or identifier, or a group of mullions are assigned the same RF address. An operator interfacing with a lighting control network can then utilize the RF address to selectively control the operation and/or lighting characteristics of all mullions, a group of mullions, or individual mullions (or display cases) within the store. For example, all mullions having an RF address corresponding to a specific function or location within the store, such as the loading dock or shipping point, can be dimmed or turned off when the store is closed for the evening. The operator can be located within the store and utilize a hand held remote to control the group of mullions and/or individual mullions. Alternatively, the operator may utilize a personal digital assistant (PDA), a computer, or a cellular telephone to control the mullions. In a broader context where stores are located across a broad geographic region, for example across a number of states or a country, the mullions in all stores may be linked to a lighting network. A network operator can then utilize the RF address to control: (a) all mullions linked to the network; (b) the mullions on a facility-by-facility basis; and/or (c) groups of mullions within a facility or collection of facilities based upon the lighting function of the mullions.

A centralized lighting controller that operably controls the mullions via the control units can be configured to interface with an existing building control system or lighting control system. The central lighting controller may already be part of an existing building control system or lighting control system, wherein the mullions and the control unit are added as upgrades. The radio frequency control unit could utilize a proprietary networking protocol, or use a standard networking control protocol. For example, standard communication protocols include Zigbee, Bluetooth, IEEE 802.11, Lonworks, and Backnet protocols.

Networked lighting controls, either radio frequency or hardwired, can be easily integrated into newly constructed devices such as refrigeration or freezer display cases when they are manufactured, due to economies, access, and technology in the manufacturing and assembly processes. It is impractical, economically, to integrate networked lighting controls, either RF or hardwired, into existing refrigeration or freezer display cases. Most existing refrigeration or freezer cases have only AC power connected to the units. Separate lighting controls could possibly be added to existing units, however, the complexity of retrofit, cost of installation, and limited functionality would be a deterrent. By embedding or integrating the radio frequency control unit directly into the fixture 710, the prohibitive costs of upgrading lighting systems in the field can be eliminated.

Figure 17:
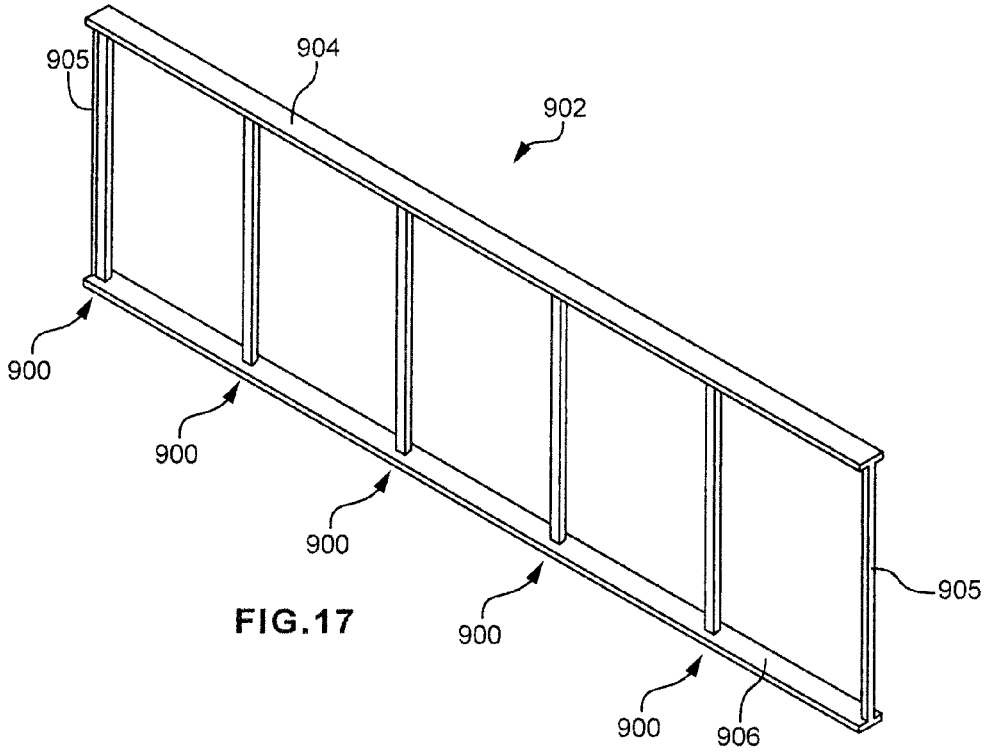
FIG. 17 is a perspective view of an LED light fixture assembly.

Referring now to FIG. 17, a free standing light fixture assembly 902 includes an elongated upper frame member 904, an elongated lower frame member 906 spaced from and extending substantially parallel to the upper frame member 904, peripheral frame members 905 extending between the upper and lower frame members 904, 906, and a plurality of LED light fixtures 900 extending between the upper and lower frame members 904, 906. The LED light fixtures 900 are spaced apart from one another and arranged substantially in parallel. The light fixture assembly 902 is particularly well suited for installation within existing structures having spaced apart vertical support members separated by open areas.

Figure 18:
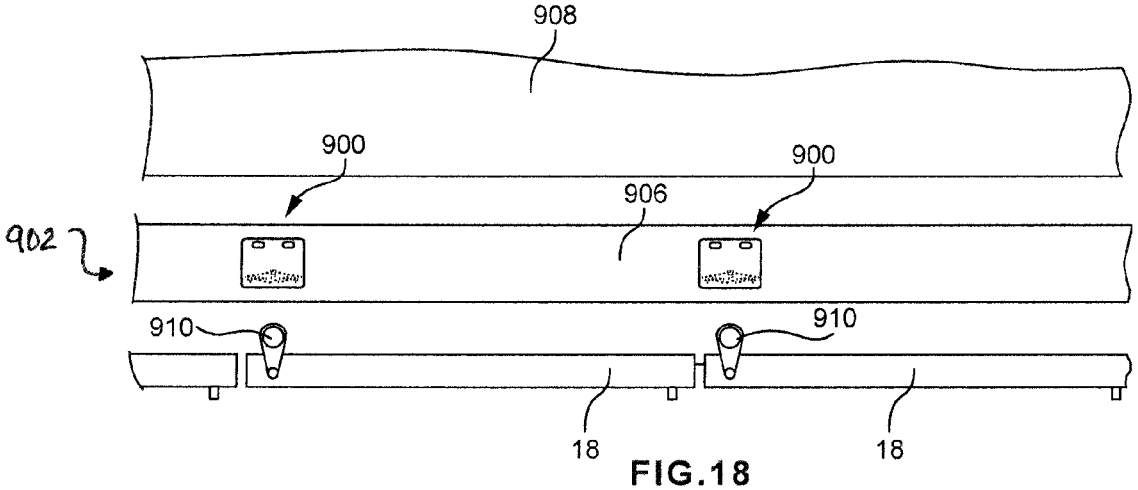
FIG. 18 is a schematic view of a refrigerated display case with the LED light fixture assembly of FIG. 17 installed therein.

Referring also to FIG. 18, one example of a suitable application for the free standing light fixture assembly 902 is the refrigerated display case 10. The display case 10 includes first and second doors 16, 18 each pivotally coupled to display case structure via hinges 910. The hinges 910 are spaced away from a shelf 908 for supporting products within the display case 10. As shown, the free standing light fixture assembly 902 may be installed in the space between the hinges 910 and the shelf 908 with the LED light fixtures 900 oriented vertically and substantially aligned with the hinges 910, and the upper and lower frame members 904, 906 oriented substantially horizontally. The light fixture assembly 902 is substantially free standing in the sense that the LED light fixtures 900 are not coupled to the doors 16, 18 or the hinges of the display case 10. Rather, the lower frame member 906 can rest on a support surface, and the LED light fixtures 900 cooperatively support the upper frame member 904, which maintains a spacing between the upper ends of the LED light fixtures 900. Straps, brackets, or similar supports may be provided between the upper frame member 904 and structure of the display case 10 for the purpose of maintaining or balancing the light fixture assembly 902 in an upright position, but such straps, brackets, are generally not relied upon as a structural component for supporting the LED light fixtures 900 or the upper or lower frame members 904, 906. This arrangement simplifies installation and removal of the light fixture assembly 902, particularly in a retrofit application. Although a variety of installations are possible, in some applications one LED light fixture 900 is positioned at each hinge 910 and LED light fixtures 900 are also provided at each end of the display case 10 along the peripheral frame member 905 (see the left side of FIG. 17).

Figure 19:
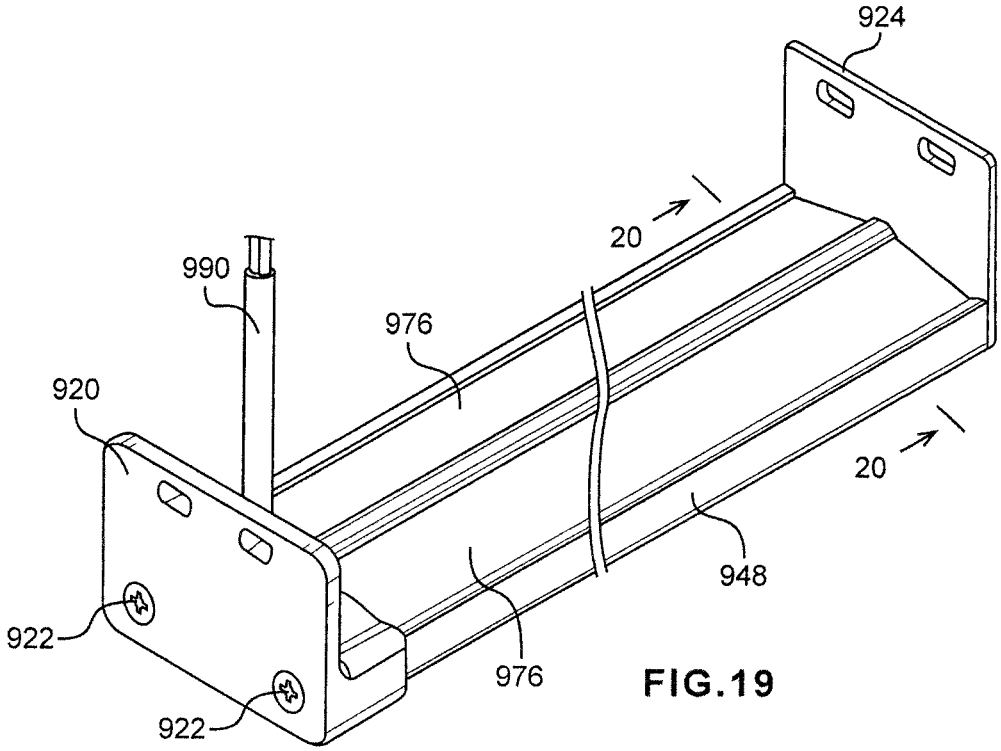
FIG. 19 is a perspective view of one LED light fixture of the LED light fixture assembly of FIG. 17.
Figure 20:
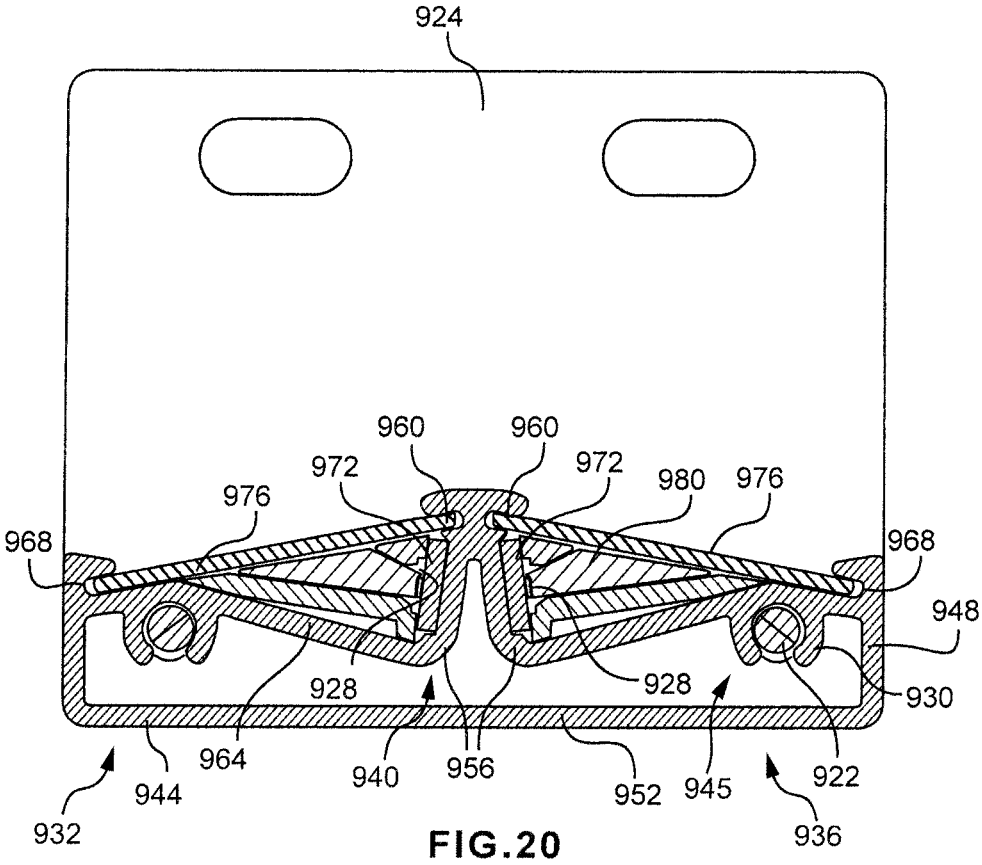
FIG. 20 is a cross-section view taken along line 20-20 of FIG. 19.

Referring also to FIGS. 19 and 20, each LED light fixture 900 includes first and second end plates 920, 924 configured for securing the LED light fixture 900 to the upper and lower frame members 904, 906 of the light fixture assembly 902. Each LED light fixture 900 includes a structural frame member 932 having a substantially channel shaped support portion 936 and a mounting portion 940 opposite the support portion 936. The support portion 936 and mounting portion 940 cooperate to define a closed box section 944 that provides an internal cavity 945 (see FIG. 20) that extends along the length of frame member 932. The closed box section 944 of each LED light fixture 900 provides additional structural rigidity to the free standing light fixture assembly 902 when the light fixture 900 is coupled to the upper and lower frame members 904, 906 via the end plates 920, 924. In the embodiment of FIG. 19, the support portion 936 of the structural frame member 932 includes a pair of substantially parallel opposed side walls 948 and a base wall 952 extending between and substantially perpendicular to the opposed side walls 948. The side walls 948 and base wall 952 cooperate to define a substantially C-shaped support portion 936. The mounting portion 940 of the structural frame member 932 extends between the distal ends of the opposed side walls 948 and includes two first walls 956 each defining a first slot 960 and two second walls 964 each defining a second slot 968. The first walls 956 and second walls 964 are arranged in pairs and each second wall 964 is angled with respect to its respective first wall 956. The end plate 920, 924 is coupled to the frame member 932 of the light fixture 900 by at least one fastener 922 that is received by a receiver 930 formed in the mounting portion 940, preferably between an end portion of the second wall 964 and the side wall 948. As shown in FIG. 20, the receiver 930 extends downward into the internal cavity 945 of the closed box section 944.

Each LED light fixture 900 also includes an LED light module 972 secured to and positioned along each of the first walls 956 of the mounting portion 940. Each LED light module 972 includes a plurality of LEDs 928 spaced along its length. As shown in FIG. 19, input leads 990 extend into the light fixture 900 to supply power to the light modules 972. A cover 976 is positioned so that light emitted from the plurality of LED light modules 972 passes through the cover 976 and away from the mounting portion 940. The cover 976 extends along and is supported by the mounting portion 940. More specifically, opposing edges of the cover 976 are received in the first slot 960 of the first wall 956 and in the second slot 968 of the second wall 964. Each LED lighting fixture 928 further includes an optical assembly 980 extending between the first wall 956, the second wall 964, and the cover 976. The optical assembly 980 directs light from the LEDs 928 through the cover 976 and toward the area to be illuminated.

While the specific embodiments have been illustrated and described, numerous modifications come to mind without significantly departing from the spirit of the invention and the scope of protection is only limited by the scope of the accompanying claims.

The invention claimed is:

1. A LED light fixture assembly comprising:

an elongated first support member;

an elongated second support member spaced from and substantially parallel to the first support member; and a plurality of elongated LED lighting fixtures coupled to and extending between the first support member and the second support member, the plurality of elongated LED lighting fixtures arranged in substantially parallel and spaced-apart relation with respect to one another, and each LED lighting fixture including:

an elongated structural frame member having a substantially channel-shaped support portion and a mounting portion opposite the support portion, the mounting portion having opposed, internal first walls, at least one LED light module disposed on one of the internal first walls, and a cover extending along and supported by the mounting portion to allow light emitted from the plurality of LED light modules to pass through the cover and away from the mounting portion.

2. The assembly of claim 1, wherein the first and second support members extend substantially horizontally with the second support member positioned above the first support member, wherein the plurality of elongated LED lighting fixtures extend substantially vertically, and wherein the second support member is supported above the first support member by the plurality of elongated LED lighting fixtures.

3. The assembly of claim 1, wherein the support portion is substantially C-shaped and includes a pair of opposed side walls and a base wall extending between the opposed side walls.

4. The assembly of claim 3, wherein the side walls are substantially parallel to one another and the base wall is substantially perpendicular to the side walls.

5. The assembly of claim 3, wherein the mounting portion extends between distal ends of the side walls, and wherein the mounting portion and the support portion cooperate to define a closed box section.

6. The assembly of claim 1, wherein each LED lighting fixture is substantially symmetric about a central plane.

7. The assembly of claim 1, wherein the mounting portion of the structural frame member has a second wall extending from a lower portion of the first wall at an angle.

8. The assembly of claim 7, wherein each LED lighting fixture further includes an optical assembly extending between the first wall, the second wall, and the cover.

9. The assembly of claim 1, wherein the cover is received by a first slot formed at an upper end portion of the first wall.

10. An elongated LED lighting fixture comprising:

an elongated structural frame member having a support portion and a mounting portion opposite the support portion, the mounting portion having opposed, internal first walls, wherein the support portion has a substantially C-shaped channel configuration with a base wall and opposed side walls extending from the base wall;

at least one LED light module disposed on one of the first walls; and, a cover extending along and supported by the mounting portion, the cover positioned so light emitted from the plurality of LED light modules passes through the cover and away from the mounting portion.

11. The assembly of claim 10, wherein the side walls are substantially parallel to one another and the base wall is substantially perpendicular to the side walls.

12. The assembly of claim 10, wherein the mounting portion extends between distal ends of the side walls, and wherein the mounting portion and the support portion cooperate to define a closed box section.

13. The assembly of claim 10, wherein the LED lighting fixture is substantially symmetric about a central plane.

14. The assembly of claim 10, wherein the mounting portion of structural frame member has a second wall extending from a lower portion of the first wall at an angle.

15. The assembly of claim 14, wherein each LED lighting fixture further includes an optical assembly extending between the first wall, the second wall, and the cover.

16. The assembly of claim 10, wherein the cover extends between a first slot formed at an upper end portion of the first wall and a second slot formed at an upper end portion of the side wall of the support portion.

17. A LED light fixture assembly for use within a refrigerated display case, the light fixture assembly comprising:

an elongated first support member;

an elongated second support member spaced from and substantially parallel to the first support member; and a plurality of elongated LED lighting fixtures coupled to and extending between the first support member and the second support member, the plurality of elongated LED lighting fixtures arranged in substantially parallel and spaced-apart relation, each LED lighting fixture including:

an elongated structural frame member having a substantially channel-shaped support portion defined by a pair of opposed side walls and a base wall extending between the opposed side walls, and a mounting portion opposite the support portion, wherein the mounting portion and the support portion cooperate to define a closed box section, the mounting portion having opposed, internal first walls, at least one LED light module secured to one of the internal first walls, and a cover extending along and supported by the mounting portion, the cover positioned so light emitted from the plurality of LED light modules passes through the cover and away from the mounting portion.

18. The LED light fixture assembly of claim 17, wherein the cover is received by a first slot formed at an upper end portion of the first wall.

19. The LED light fixture assembly of claim 17, wherein the cover extends between a first slot formed at an upper end portion of the first wall and a second slot formed at an upper end portion of the side wall of the support portion.

20. The LED light fixture assembly of claim 17, wherein the refrigerated display case includes a plurality of openable doors that provide access to contents within the display case, and wherein the light fixture assembly is positioned inward of the openable doors.

21. The LED light fixture assembly of claim 20, wherein each of the openable doors is pivotally connected to the display case by a hinge member, and wherein a single LED lighting fixture is cooperatively positioned with a hinge member.

* * * * *